US007568441B2

(12) United States Patent
Fukao

(10) Patent No.: US 7,568,441 B2
(45) Date of Patent: Aug. 4, 2009

(54) EMBROIDERY UNIT ATTACHABLE TO SEWING MACHINE BED

(75) Inventor: Hiroaki Fukao, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 251 days.

(21) Appl. No.: 11/658,645

(22) PCT Filed: Jul. 21, 2005

(86) PCT No.: PCT/JP2005/013387

§ 371 (c)(1),
(2), (4) Date: Feb. 16, 2007

(87) PCT Pub. No.: WO2006/011413

PCT Pub. Date: Feb. 2, 2006

(65) Prior Publication Data

US 2008/0121155 A1 May 29, 2008

(30) Foreign Application Priority Data

Jul. 27, 2004 (JP) ..... 2004-218238

(51) Int. Cl.
*D05B 39/00* (2006.01)
*D05B 27/24* (2006.01)
*D05B 35/00* (2006.01)

(52) U.S. Cl. ..... 112/470.18; 112/168; 112/324

(58) Field of Classification Search ..... 112/323, 112/324, 168, 78, 102–103, 470.14, 470.18, 112/470.06
See application file for complete search history.

(56) References Cited

U.S. PATENT DOCUMENTS

| | | | | |
|---|---|---|---|---|
| 2,682,243 | A * | 6/1954 | Matuzas | 112/314 |
| 5,048,435 | A * | 9/1991 | Takenoya et al. | 112/168 |
| 6,035,792 | A * | 3/2000 | Yoshida | 112/103 |
| 6,082,279 | A * | 7/2000 | Ito et al. | 112/314 |

FOREIGN PATENT DOCUMENTS

| | | |
|---|---|---|
| JP | B2 2879272 | 1/1999 |
| JP | A 11-114254 | 4/1999 |
| JP | B2 3292467 | 3/2002 |

* cited by examiner

*Primary Examiner*—Ismael Izaguirre
(74) *Attorney, Agent, or Firm*—Oliff & Berridge, PLC

(57) ABSTRACT

An embroidery unit (30) attachable to a sewing machine bed (1) of a sewing machine (M) capable of executing a normal mode executing sewing operation while vertically moving a feed dog (13) provided in the sewing machine bed (1) and an embroidery mode executing sewing operation while maintaining the feed dog (13) below a needle plate (1*b*) and provided with an embroidery frame feed mechanism moving an embroidery frame (33) holding a workpiece cloth provided with a mode switch unit (35) for selectively switching the feed dog (13) between the normal mode and the embroidery mode with the embroidery unit attached to the sewing machine bed (1); and a selection switch unit (50) switching status of the mode switch unit to embroidery mode in synchronization with a removing operation when removing the embroidery unit from the sewing machine bed (1).

7 Claims, 19 Drawing Sheets

EMBROIDERY UNIT ATTACHABLE TO SEWING MACHINE BED

TECHNICAL FIELD

The present invention relates to an embroidery unit provided with an embroidery frame feed mechanism feeding an embroidery frame holding a workpiece cloth, which embroidery unit is detachably attached to a sewing machine bed.

BACKGROUND ART

Conventionally, sewing machines allowing detachable attachment of an embroidery unit, housing an embroidery frame carrier mechanism therein, to a sewing machine bed (free arm) have been provided, which embroidery unit allows embroidery sewing operation by moving an embroidery frame holding a workpiece cloth in two perpendicular directions (X, Y directions). In such types of sewing machines, various types of utility stitches such as lock stitches and zigzag stitches can be sewn (normal mode) based on cloth feed operation executed by vertically (and longitudinally) moving a feed dog when the embroidery unit is detached (removed).

When the embroidery unit is attached to the free arm, electrical connection is established by connecting the sewing machine connector and the embroidery unit connector. Also, embroidery sewing is executed in an embroidery mode with the feed dog is maintained in a lowered state where the feed dog lowered below a needle plate. In the embroidery mode, the feed dog is prevented from interfering with embroidery sewing by restraining the feed dog from projecting above the upper surface of the needle plate.

For example, JP 3292467 B discloses a sewing machine provided with a mechanism that automatically switches the feed dog from the normal mode to the embroidery mode when the embroidery unit is attached to the sewing machine. In the disclosed sewing machine, the feed dog is vertically moved in synchronism with the vertical movement of the needle bar by placing a vertically moving lever in abutment with an eccentric cam provided on the lower shaft with the embroidery unit in a detached state. The eccentric cam, having integrally provided with a concentric cam disallowing the rise of the feed dog, is arranged movably in the shaft direction, whereupon attachment of the embroidery unit, a presser piece rotates a horizontal rotary lever which in turn slides the eccentric cam to bring the vertically moving lever in abutment with a concentric cam, thereby maintaining the feed dog in the lowered state.

Recent demands to sew larger embroidery patterns have increased the size of the embroidery frames, and consequently the size of the embroidery unit. Under such circumstances, sewing machines have been suggested that allows the embroidery unit to be used as an auxiliary table and allow execution of cloth feed by the feed dog with the embroidery unit attached to the free arm (embroidery frame removed). In such case, since both utility sewing and embroidery sewing can be executed with the embroidery unit attached, the user must be allowed to switch the mode of the feed dog between the normal mode and the embroidery mode.

DISCLOSURE OF THE INVENTION

Problems to be Overcome by the Invention

The above sewing machine capable of executing both utility sewing and embroidery sewing with the embroidery unit attached thereto assumes two possible states when the embroidery unit is removed from the sewing machine bed a state corresponding to embroidery mode and a state corresponding to normal mode. Thus, next time the embroidery unit is attached to the sewing machine bed, the user may encounter a case where an operation member and a conveyor member of the embroidery unit is in the state corresponding to the normal mode despite user's intention to execute embroidery sewing. In such case, the feed dog is in the normal mode even after attachment of the embroidery unit.

Thus, the user is required to verify the current mode of the feed dog (whether the operation member is in the position corresponding to the embroidery mode) before starting the sewing operation after attachment of the embroidery unit to the sewing machine bed. If embroidery sewing is started without such verification, the feed dog in normal mode is vertically moved while the embroidery frame is moved in the embroidery unit, thereby impairing the quality of embroidery sewing process due to problems such as thread in the underside of the workpiece cloth being caught by the feed dog. Also, when it has been verified that the feed dog is in the normal mode, the user is required to make a switching operation to the embroidery mode which may be troublesome for the user and consequently cause delay in sewing start.

Thus, an object of the present invention is to provide an embroidery unit attachable to the sewing machine bed which embroidery unit allows mode switching of the feed dog of the sewing machine bed, whereupon attachment of the embroidery unit to the sewing machine bed to execute an embroidery sewing operation by the user, the embroidery sewing operation can be executed smoothly.

MEANS TO OVERCOME THE PROBLEM

An embroidery unit attachable to a sewing machine bed of a sewing machine capable of executing a normal mode executing sewing operation while vertically moving a feed dog provided in the sewing machine bed and an embroidery mode executing sewing operation while maintaining the feed dog below a needle plate and provided with an embroidery frame feed mechanism moving an embroidery frame holding a workpiece cloth, comprising a mode switch unit for selectively switching the feed dog between the normal mode and the embroidery mode with the embroidery unit attached to the sewing machine bed; and a selection switch unit switching status of the mode switch unit to embroidery mode in synchronization with a removing operation when removing the embroidery unit from the sewing machine bed.

EFFECT OF THE INVENTION

The embroidery unit attachable to the sewing machine bed in accordance with the present invention allows mode switching of the feed dog in the sewing machine bed by the mode switch unit, whereupon detachment of the embroidery unit from the sewing machine bed, the selection switch unit automatically switches the status of the mode switch unit to the embroidery mode side in synchronization with the detaching motion, thereby allowing smooth initiation of embroidery sewing operation without imposing troublesome verification and operation on the part of the user when the user attaches the embroidery unit to the sewing machine bed with the intention to execute an embroidery sewing operation.

EXPLANATION OF REFERENCE SYMBOLS

Reference symbol M designates a sewing machine; 10 a feed dog vertically-moving mechanism, 11 a lower shaft, 12 a vertical feed cam, 12*a* an eccentric cam, 12*b* a concentric cam, 13 a feed dog, 18 a vertical feed contact, 20 a feed dog lowering mechanism, 21 a contact moving mechanism, 22 a manual switching lever, 30 an embroidery unit, 31 a body casing 31, 31*e* switch incline cam (switching member), 33 an embroidery frame, 35 a mode switch mechanism (mode switch unit), 36 a manual operating lever, 37 an activating mechanism, 38 a detection switch (detection unit), 47 an activating plate, 50 a selection switch mechanism (selection switch unit), 51 a lock mechanism, 52 an unlock lever, and 65 a control unit (control section).

THE BEST MODE FOR CARRYING OUT THE INVENTION

The present invention will be described in detail with reference to the accompanying drawings.

Figure 1:
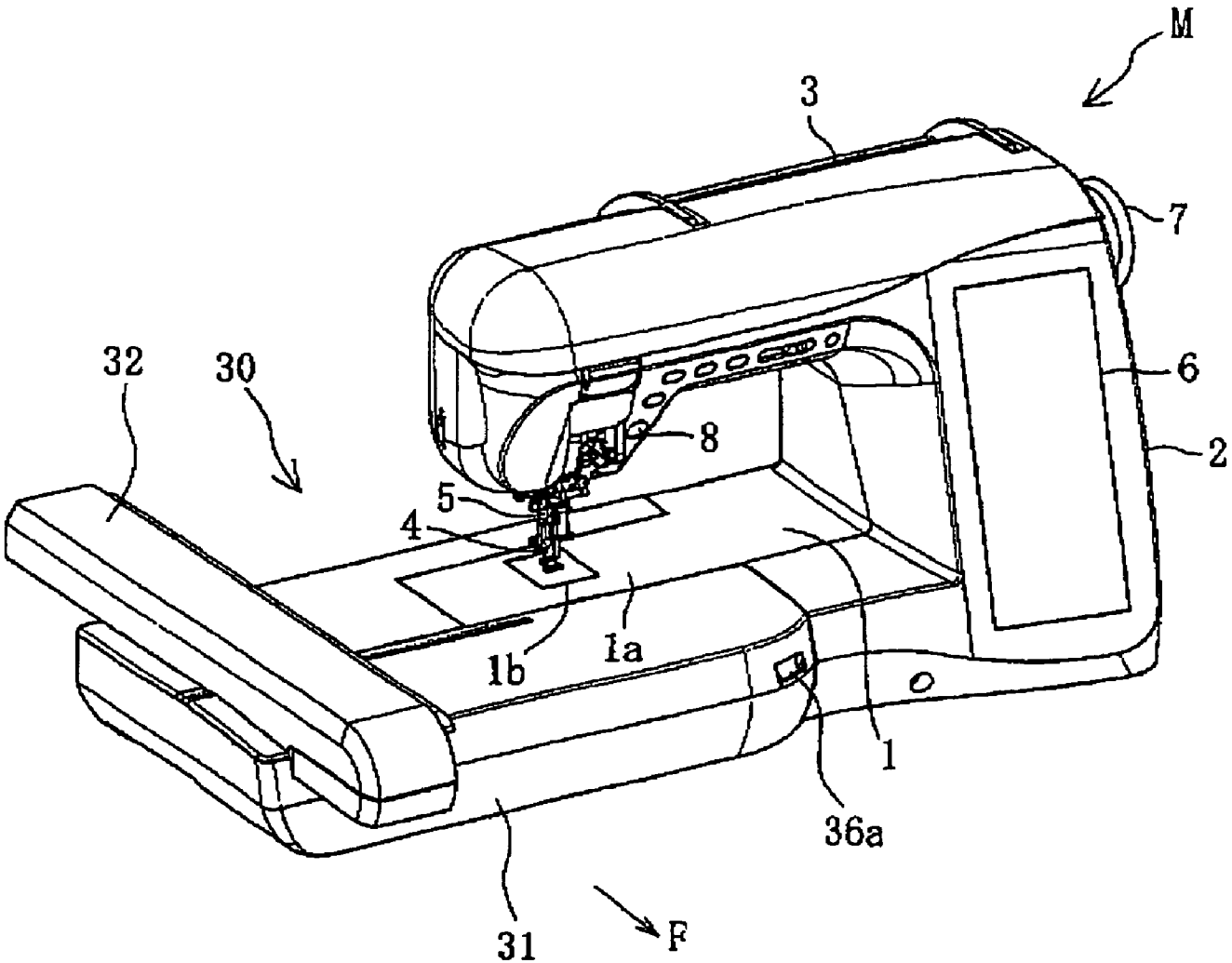
FIG. 1 indicates one illustrative aspect of the present invention showing a plan view of a sewing machine with an embroidery unit attached.

The drawings illustrate one embodiment of the invention. FIG. 1 shows an embroidery unit 30 in accordance with the present embodiment being attached to a sewing machine M. The configuration of the sewing machine M, being a general household electronic sewing machine, will firstly be described hereinafter. The arrows F in the drawings indicate the front side.

Figure 2A:
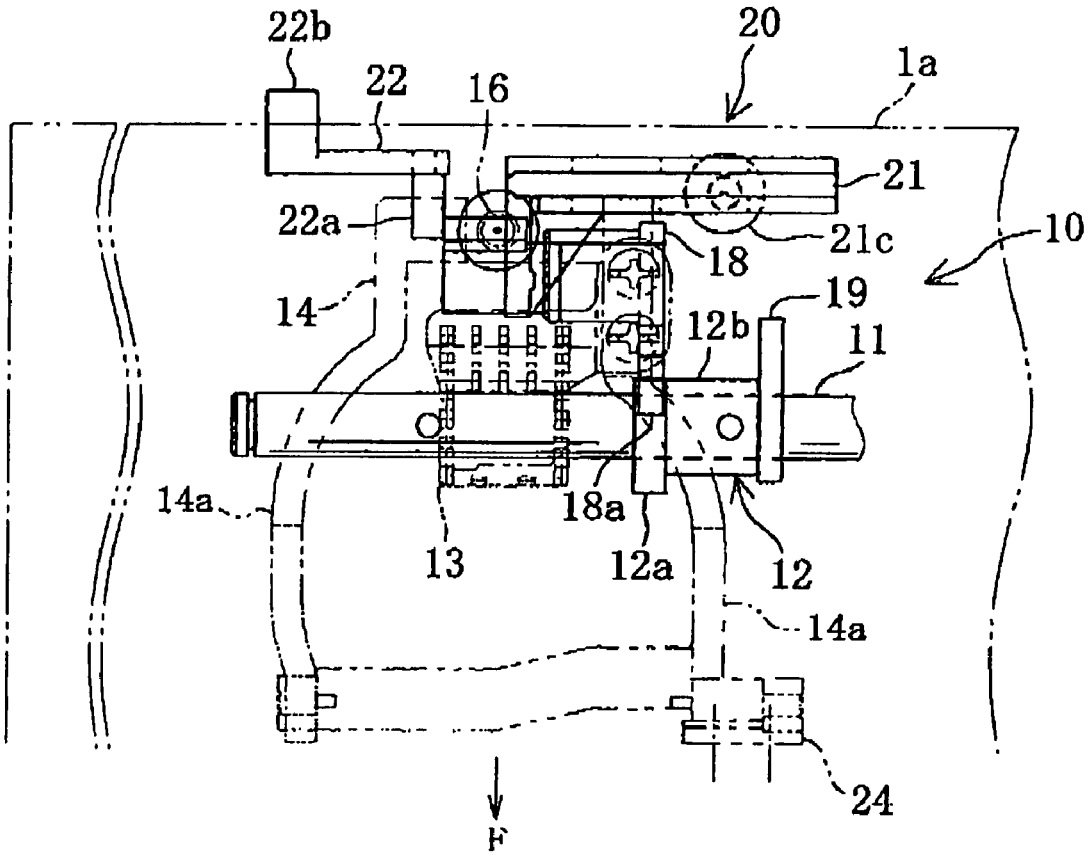
FIG. 2A is a plan view of a vertically-moving mechanism and a lowering mechanism of a feed dog in normal mode.

The sewing machine M is integrally provided with a sewing machine bed 1; a foot 2 standing upward from the right end of the sewing machine bed 1; and an arm 3 extending leftward from the upper end of the foot 2 as viewed in the drawings. The distal end of the sewing machine bed 1 serves as a free arm 1*a* allowing sewing of cylindrical workpiece cloth. Also, a lower shaft 11 (refer to FIG. 2A) is provided inside the sewing machine bed 1 (free arm 1*a*).

A needle bar 5 having a sewing needle 4 is provided in the lower portion of the arm 3 distal end. A needle plate 1*b* associated with the needle bar 5 is provided on the upper surface of the free arm 1*a*. Though not shown in detail, positioned inside the free arm 1*a* below the needle plate 1*b* is a unit composed of a feed dog vertically-moving mechanism 10 and a feed dog longitudinally moving mechanism that moves the feed dog 13 (refer to FIG. 2A for example) vertically and longitudinally; a feed dog lowering mechanism 20; a horizontal rotary hook 9 (refer to FIG. 2C) accommodating a bobbin thread bobbin therein and forming stitches co-operatively with the sewing needle 4; and a thread cutter mechanism; and the like. The feed dog vertically-moving mechanism 10 and the horizontal rotary hook 9 are driven in synchronization with the lower shaft 11. The details of the feed dog vertically-moving mechanism 10 and the feed dog lowering mechanism 20 will be described afterwards.

Though also not shown, a laterally oriented sewing machine main shaft being rotationally driven by a sewing machine motor is provided inside the arm 3. Further, provided inside the arm 3 are a needle bar drive mechanism that vertically moves the needle bar 5; a needle bar swing mechanism that swings the needle bar 5 in a direction (lateral direction) perpendicular to the cloth feed direction; a thread take-up drive mechanism that vertically moves a thread take-up in synchronization with the vertical movement of the needle bar 5; and the like. Each of the aforementioned mechanisms is driven in synchronization with the sewing machine main shaft. Also, the lower shaft 11 is also rotationally driven by the sewing machine motor conjunctively (in synchronization) with the sewing machine main shaft.

Provided in the front face of the foot 2 is a large-size elongate liquid crystal display 6 capable of full-color display. The display 6 shows various stitch patterns such as utility stitches and embroidery patterns; function names for executing various functions required for the sewing work; and various messages, and the like. Well-known touch panels made of transparent electrodes are provided on the surface of the display 6. Also, a hand pulley 7 allowing manual rotation of the sewing machine shaft is provided in the right side face of the arm 3. Various switches such as a start/stop switch 8 instructing starting and stopping of the sewing work is provided in the front face of the arm 3.

Thus, a sewing operation is executed by each of the aforementioned mechanism driven in synchronization with the sewing machine main shaft which is rotationally driven by the sewing machine motor. At this time, when the embroidery unit 30 is detached, utility sewing such as lock stitch sewing and zigzag sewing is executed by feeding the workpiece cloth over the sewing machine bed 1 by the vertical and longitudinal movement of the feed dog 13 in the normal mode. Even when the embroidery unit 30 is detached, sewing operation (quilting and buttoning, etc.) can be executed without cloth feeding operation of the feed dog 13 by operating a later described manual switching lever 22.

The embroidery unit 30 in accordance with the present embodiment is detachably attached to the left-end side portion of the sewing machine bed 1 (free arm 1*a*). The embroidery unit 30 is designed to execute embroidery sewing operation by freely moving an embroidery frame 33 (refer to FIGS. 4 and 5) holding a workpiece cloth not shown over the upper surface of the sewing machine bed 1 in the X-direction (lateral direction) and the Y-direction (longitudinal direction).

Figure 4:
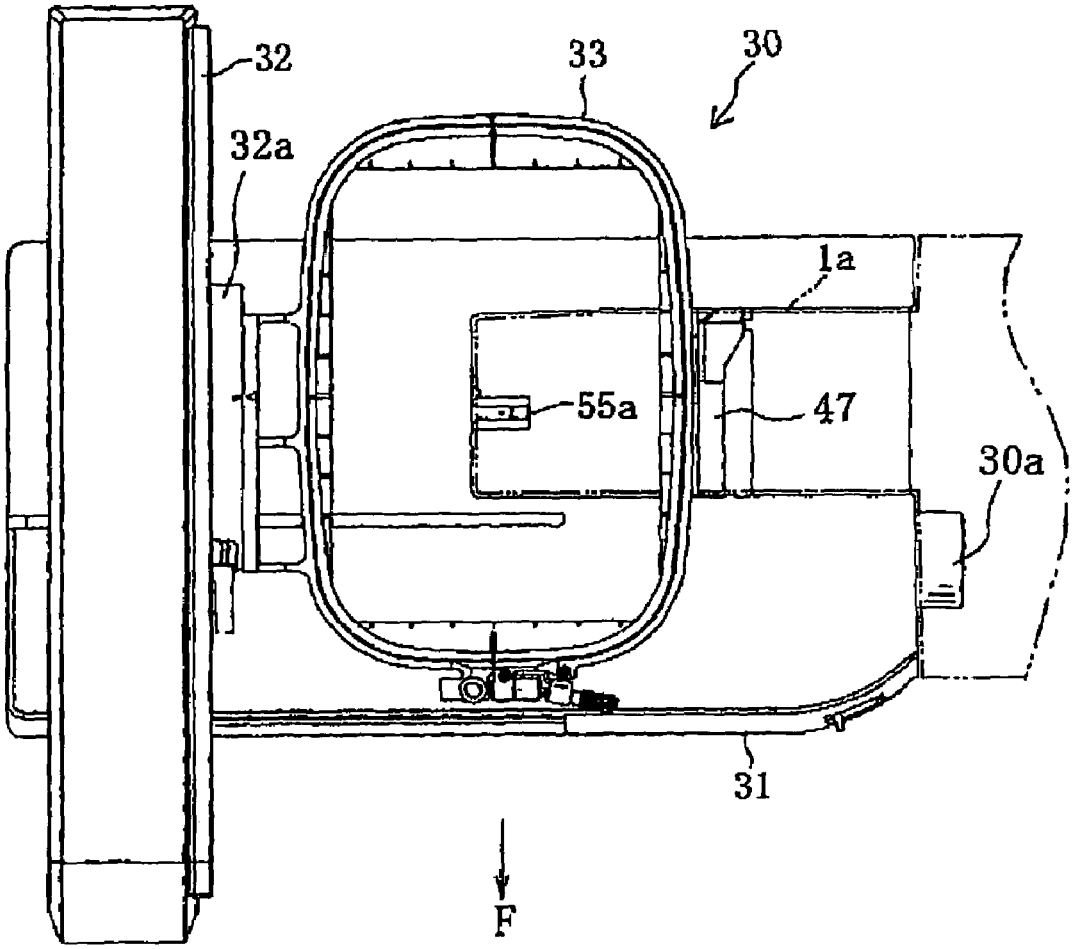
FIG. 4 is a plan view of the embroidery unit.
Figure 5:
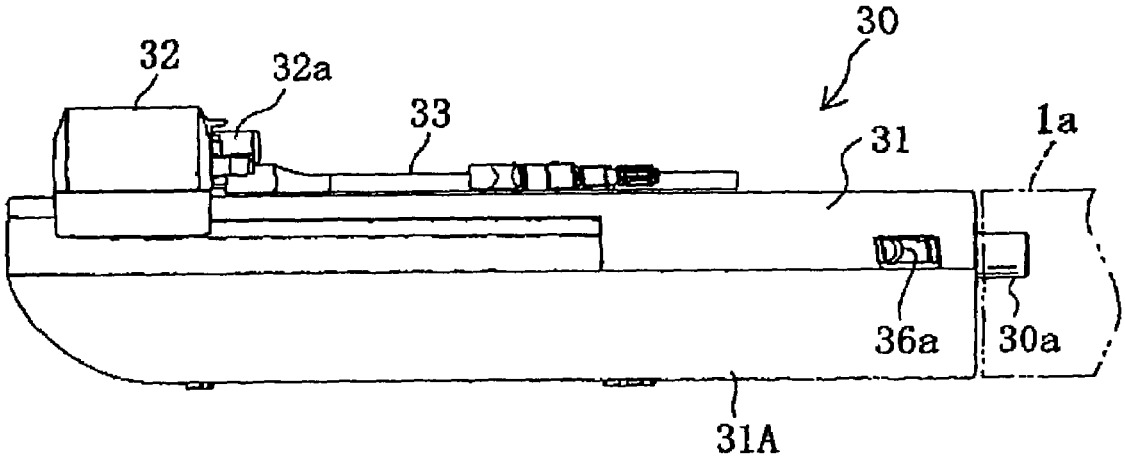
FIG. 5 is a front view of the embroidery unit.
Figure 9:
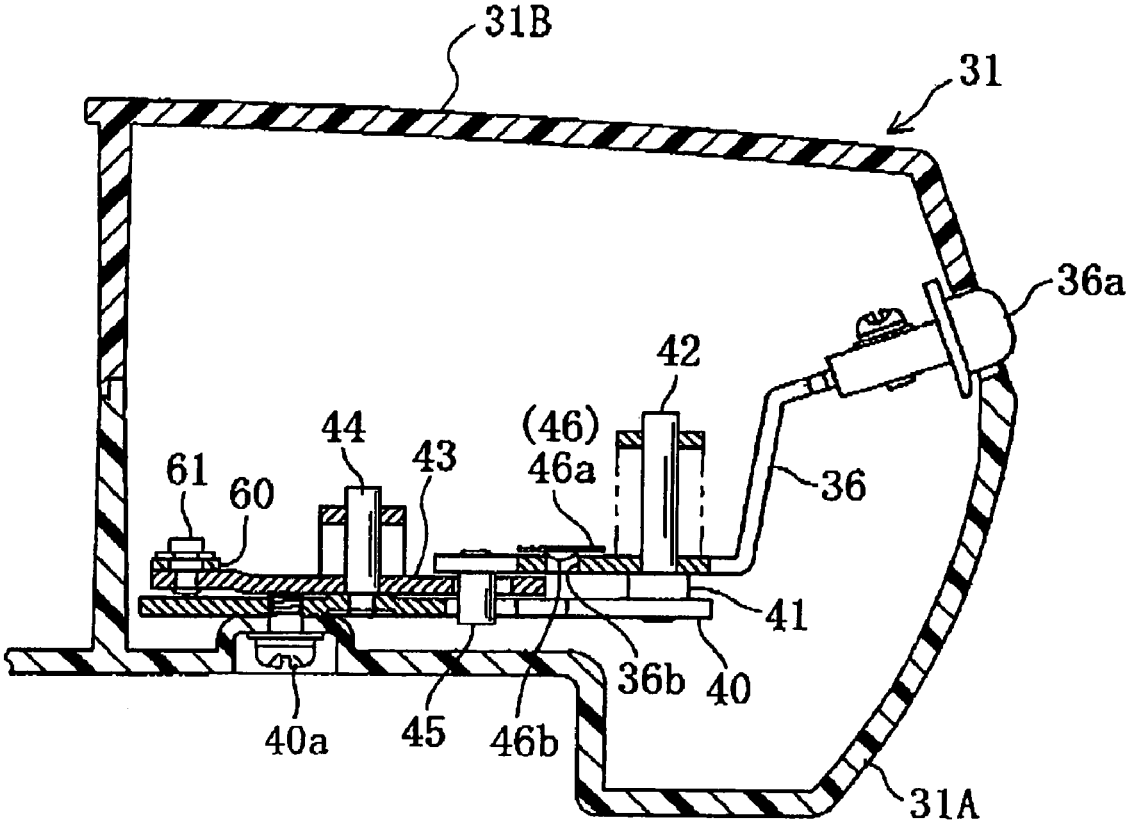
FIG. 9 is a vertical side view taken along line 9-9 in FIG. 8.

As can be seen in FIGS. 4 and 5 also, the embroidery unit 30 is provided with a body casing 31 and a movable case 32 provided on the upper surface of the body casing 31 so as to be movable in the X-direction. As shown in FIG. 9, the body casing 31 is configured by a lower casing 31A and an upper casing 31B mated with one another and takes a thin, rectangular box shape in its entirety. Also, the right-half portion of the body casing 31 has formed therein a bed receiving portion 31*d* (refer to FIG. 6A, for example) to which the free arm 1*a* is relatively fitted when body casing 31 is attached to the free arm 1*a*. Also, a connector 30*a* for establishing electrical connection with the sewing machine M is provided in the right end of the body casing 31. When the embroidery unit is attached, the upper surface of the body casing 31 is at level with the upper surface (bed surface) of the sewing machine bed 1 while the connector 30*a* establishes connection with a control unit 65 (refer to FIG. 11) of the sewing machine M.

The movable case 32 takes a rectangular box shape elongated in the longitudinal (Y) direction and has a carriage 32*a* provided in the right side face thereof to which the embroidery frame 33 is detachably attached to render Y-directional movement of the embroidery frame 33. Though not shown, an X-feed motor and an X-direction drive mechanism for driving the movable case 32 in the X-direction is provided inside the body case 31. Provided inside the movable case 32 are a Y-feed motor and a Y-direction drive mechanism for driving the carriage 32*a* in the Y-direction. Thus, an embroidery frame feed mechanism that moves the embroidery frame 33 freely in the X- and Y-directions respectively is configured.

The embroidery mode being set with the embroidery unit 30 being attached to the sewing machine bed 1, the feed dog 13 is maintained in a lowered state below the needle plate 1*b*. In such state, the embroidery sewing operation is executed on the workpiece cloth held by the embroidery frame 33 by controlling the movement of the embroidery frame 33 in the X-direction and the Y-direction based on embroidery data, or the like. At this time, as described later, the embroidery unit 30 is provided with a lock mechanism 51 for locking itself in attachment with the sewing machine bed 1. Furthermore, an unlock lever 52 is provided for canceling the lock when the user (sewer) removes the embroidery unit 30 from the sewing machine bed 1.

Even when the above described embroidery unit 30 is attached, a switch can be made from the embroidery mode to the normal mode by user operation of the later described manual operating lever 36. At this time, the body casing 31 may be used as an auxiliary bed and utility sewing may be executed with the embroidery frame 33 removed for example.

The configuration of the feed dog vertically-moving mechanism 10 and the feed dog lowering mechanism 20 provided in the sewing machine bed 1 will be described with reference to FIGS. 2A to 2D and 3A to 3D. First, a description will be given on the feed dog vertically-moving mechanism 10.

Provided inside the free arm 1*a* is a laterally extending lower shaft 11. A vertical feed cam 12 is secured on the lower shaft 11 as well as a longitudinal-movement cam 19 composed of an eccentric cam positioned at the right side thereof. The vertical feed cam 12 is integrally provided with an eccentric cam 12*a* for vertically moving the feed dog 13 and a concentric cam 12*b* positioned to the right side thereof for maintaining the feed dog 13 in a lowered position. The radius of the cam surface of the concentric cam 12*b* is arranged to be equal to the smallest radius of the cam surface of the eccentric cam 12*a*, and also, the concentric cam 12*b* is configured to have a longer axial dimension.

Figure 12A:
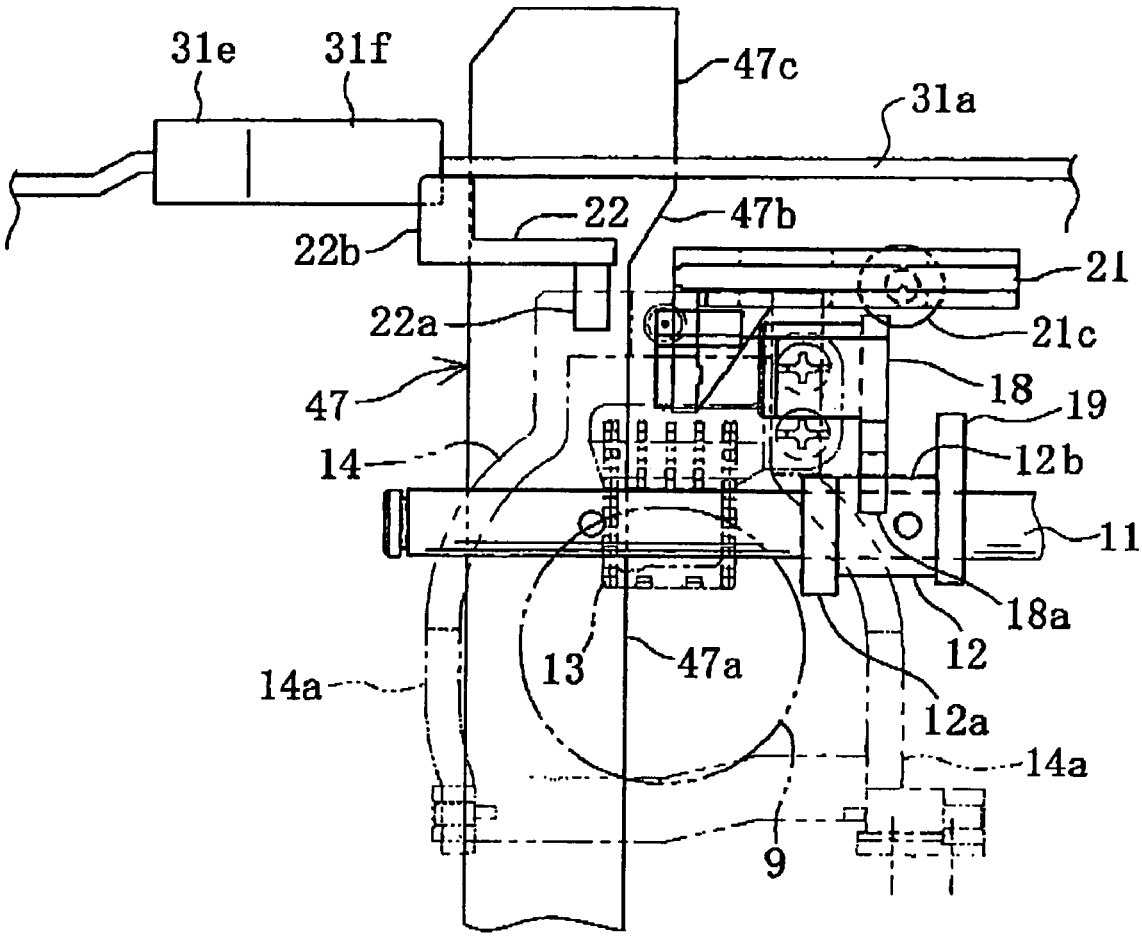
FIG. 12A is a front view indicating status of the vertically-moving mechanism and the lowering mechanism of the feed dog when the embroidery unit is being attached to the free arm.
Figure 13A:
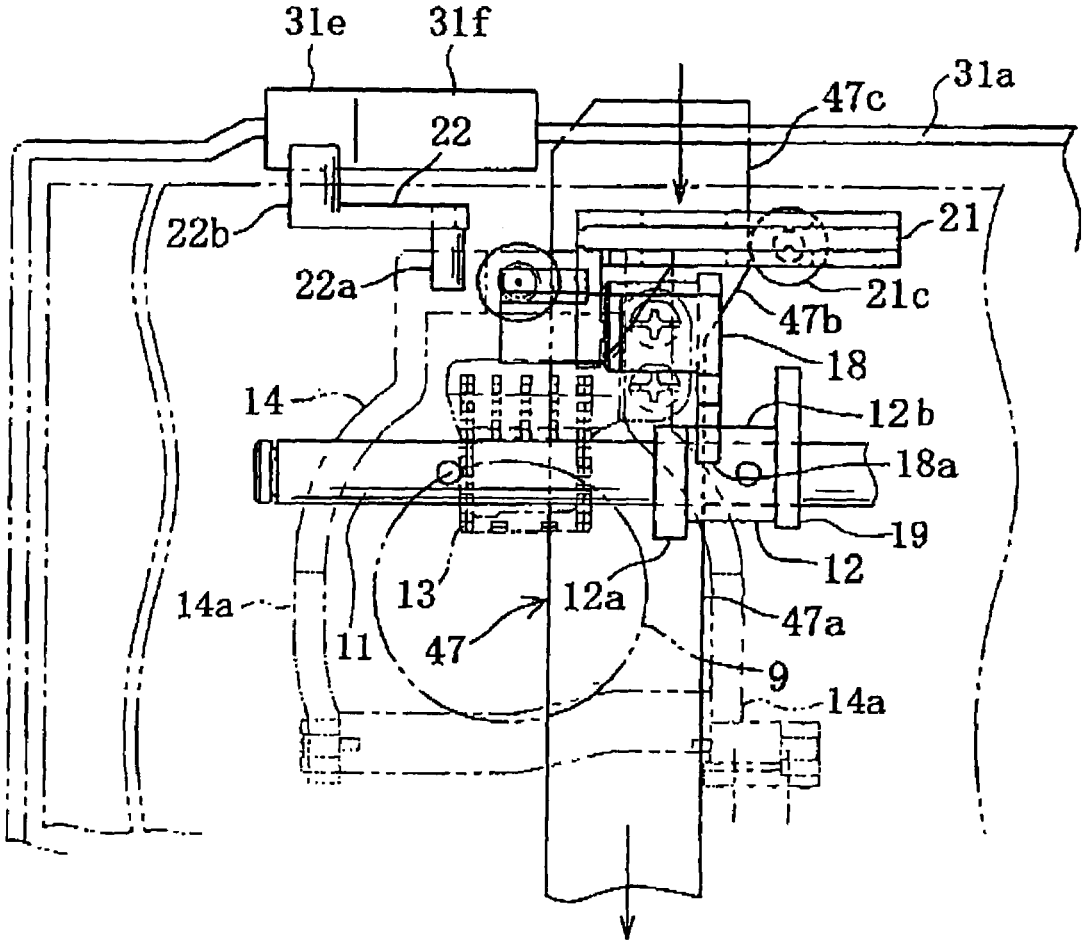
FIG. 13A is a front view indicating status of the vertically-moving mechanism and the lowering mechanism of the feed dog with the embroidery unit is attached.

On the other hand, the feed dog 13 is secured on the upper surface of the feed base 14, and is provided vertically movably between the cloth feed position (refer to FIG. 2C) projecting above the needle plate 1*b* from a plurality of square holes (not shown) defined in the needle plate 1*b* and the lowered position (refer to FIG. D) below the needle plate 1*b*. As can be seen from the drawings such as FIGS. 12A and 13A, provided integrally on the front-end sides of the feed base 14*a* is a pair of arms 14*a* originating from the lateral sides thereof, the pair of forwardly extending arms 14*a* taking a bifurcated profile. The arms 14*a* are opened so as to laterally circumvent the horizontal rotary hook 9, and the front-end portions of the arms 14*a* are respectively connected rotatably to the upper ends of left and right pair of longitudinal swing lever 24.

Figure 2B:
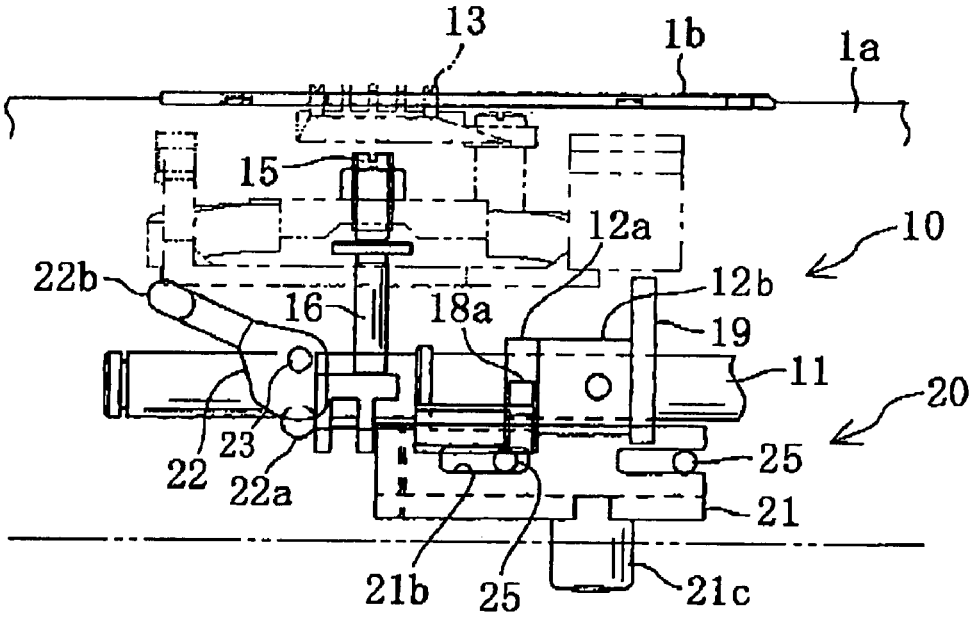
FIG. 2B is a front view of the vertically-moving mechanism and the lowering mechanism of the feed dog in normal mode.
Figure 2C:
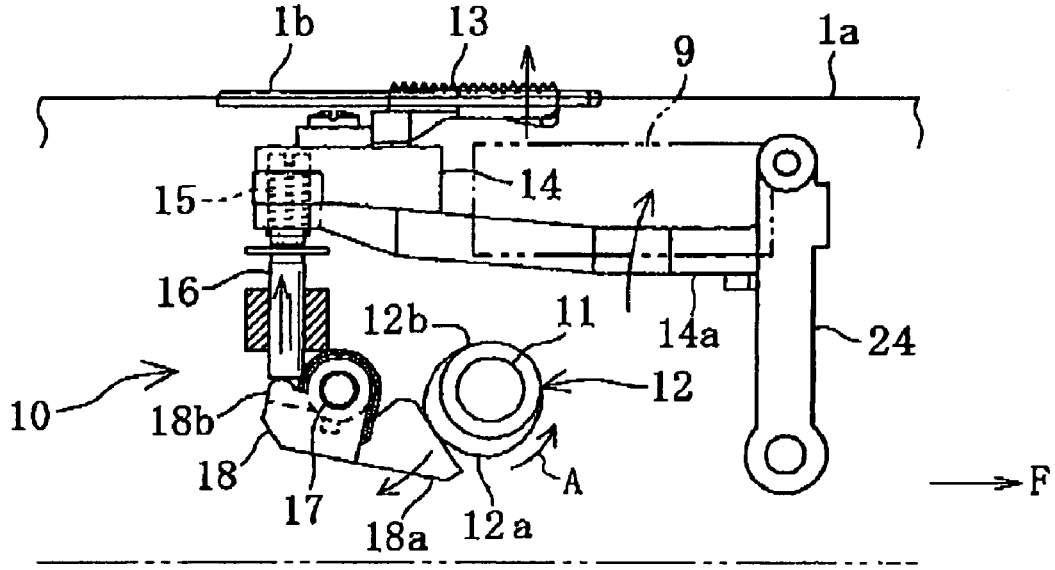
FIG. 2C is a side view of the vertically-moving mechanism and the lowering mechanism of a raised feed dog in normal mode.

The longitudinal swing lever 24 is swung longitudinally by a feed dog longitudinally-moving mechanism (not shown) via the longitudinal-movement cam 19. Thus, the feed base 14 and consequently the feed dog 13 are moved longitudinally. Also, as shown in FIGS. 2B and 2C for example, a height adjustment bolt 15 is provided at the rear end of the feed base 14, and the lower end of the height adjustment bolt 15 is placed in abutment with the upper end of a vertically-oriented vertical-movement pin 16. The rear end of the feed base 14 is subject to consistent downward bias by an extension spring not shown.

Figure 2D:
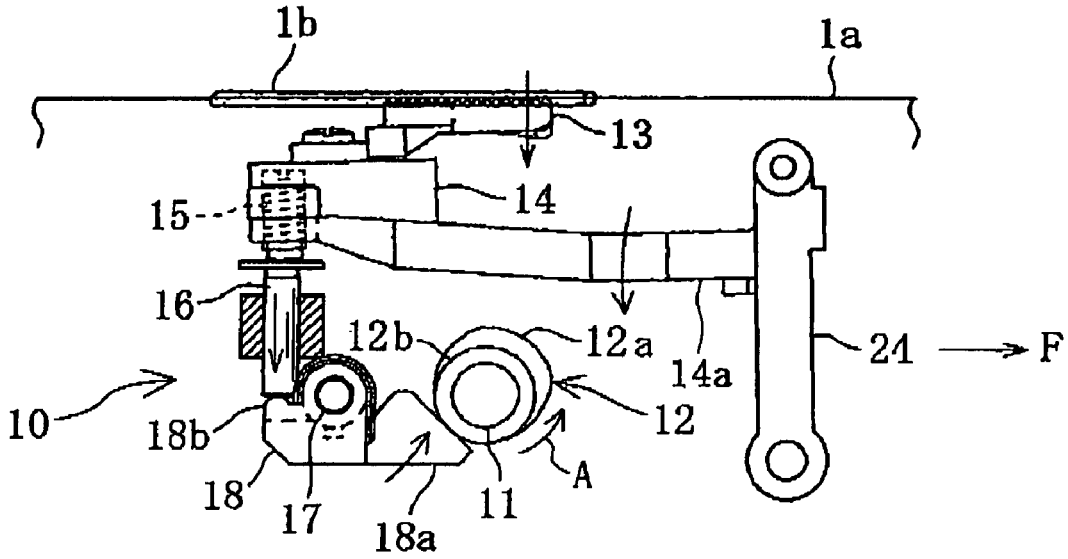
FIG. 2D is a side view of the vertically-moving mechanism and the lowering mechanism of a lowered feed dog in normal mode.

As shown in FIGS. 2C and 2D, for example, a cam shaft 17 is disposed in the rear side of the lower shaft 11 in parallel relation thereto, and the a vertical feed contact 18 is provided on the cam shaft 17 in a laterally slidable manner. A cam contact 18*a* is formed at the distal end of the vertical feed contact 18, and an abutment portion 18*b* is formed in the rear-end side thereof. At this point, the vertical feed cam 18 is subject to consistent leftward (direction contacting the eccentric cam portion 12*a*) bias by a compression coil spring not shown.

The cam contact 18*a* selectively contacts the eccentric cam 12*a* or the concentric cam 12*c*. Also, the abutment portion 18*b* is placed in abutment with the lower end of the vertical movement pin 16 from below. Thus, the abutment of the lower end of the height adjustment bolt 15 and the upper end of the vertical movement pin 16, the abutment of the lower end of the vertical movement pin 16 and the abutment portion 18*b*, and the abutment of the cam contact 18*a* and the eccentric cam 12*a* (or concentric cam 12*c*) are retained respectively.

At this time, in case the cam contact 18*a* is in contact with the eccentric cam 12*a*, as shown in FIG. 2D, and when the cam contact 18*a* is in abutment with the smaller radius of the eccentric cam 12*a*, the vertical movement pin 16 is placed in the lowered position and the feed dog is placed in the lower side. As shown in FIG. 2C, when the cam contact 18*a* is in abutment with the larger radius of the eccentric cam 12*a*, the vertical feed contact 18 is rotated to raise the vertical movement pin 16 whereby the feed dog is also raised.

When the lower shaft 11 is rotationally driven in the predetermined rotary direction (arrow A direction), the rotation of the eccentric cam 12*a* vertically swings the cam contact 18*a*. Thus, the vertical movement pin 16 is vertically moved via the vertical feed contact 18 and the rear end of the feed base 14 is vertically moved in synchronization therewith, and the feed dog 13 is vertically moved between a cloth feed position shown in FIG. 2C and the lowered position shown in FIG. 2D. At the same time, the longitudinal movement of the feed dog 13 rendered by the rotational drive of the longitudinal feed cam 19 renders execution of cloth feed. Thus, the abutment of the cam contact 18*a* with the eccentric cam 12*a* constitutes the normal mode.

Figure 3A:
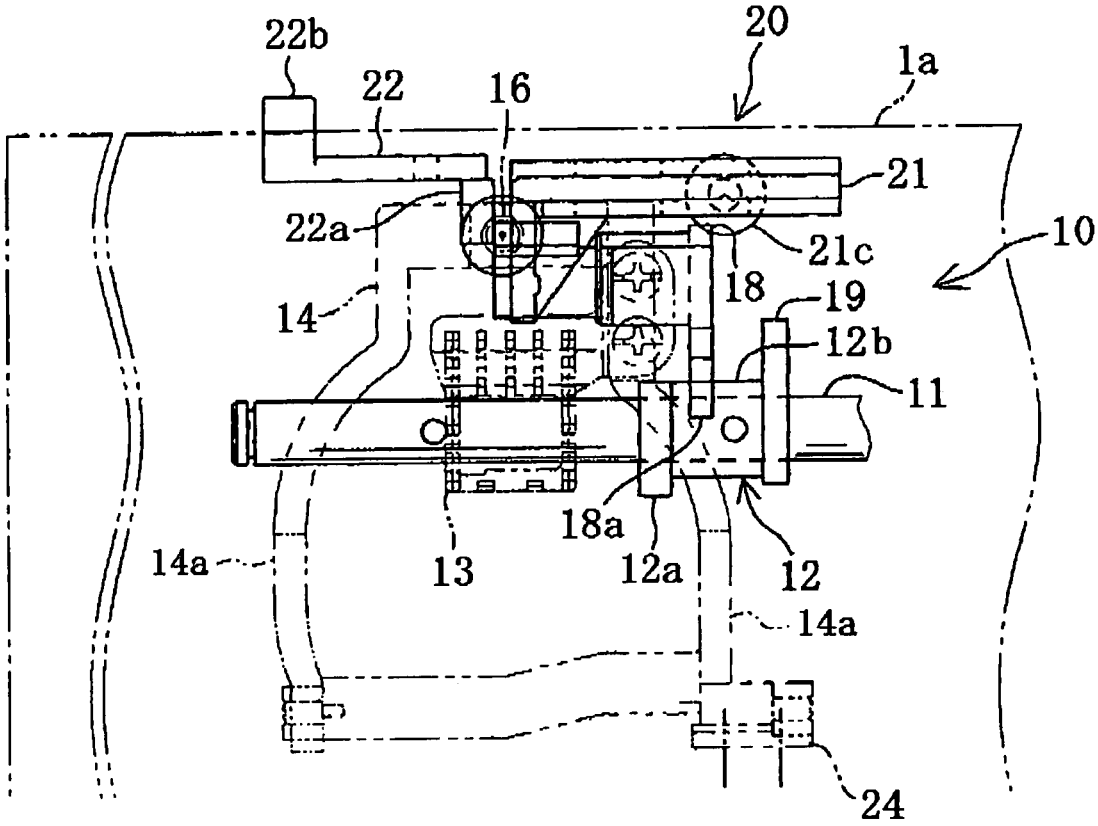
FIG. 3A is a plan view of the vertically-moving mechanism and the lowering mechanism of the feed dog in embroidery mode.
Figure 3B:
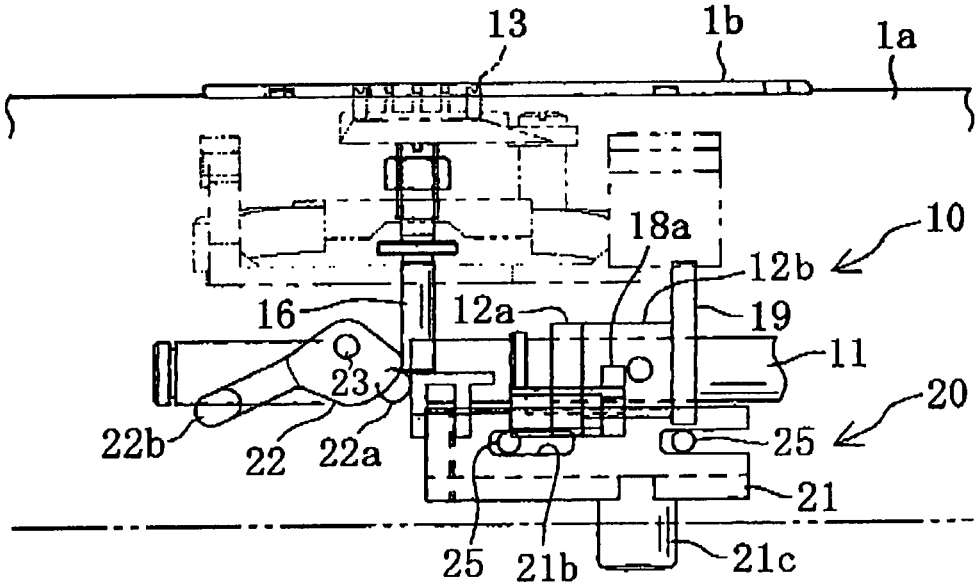
FIG. 3B is a front view of the vertically-moving mechanism and the lowering mechanism of the feed dog in embroidery mode.
Figure 3C:
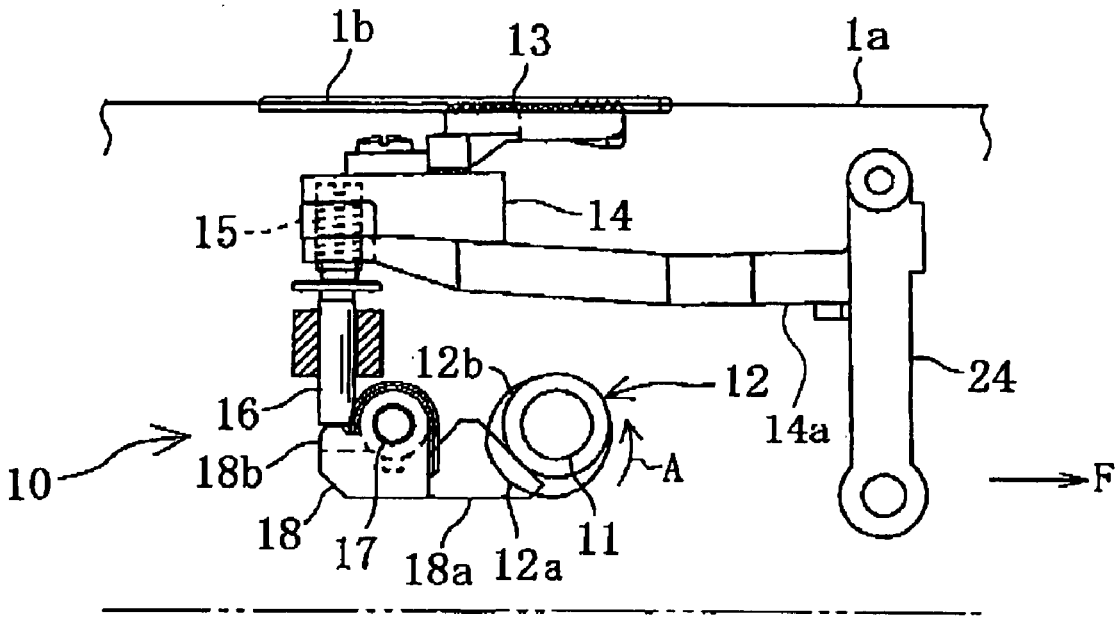
FIG. 3C is a side view of the vertically-moving mechanism and the lowering mechanism of the feed dog in embroidery mode.
Figure 3D:
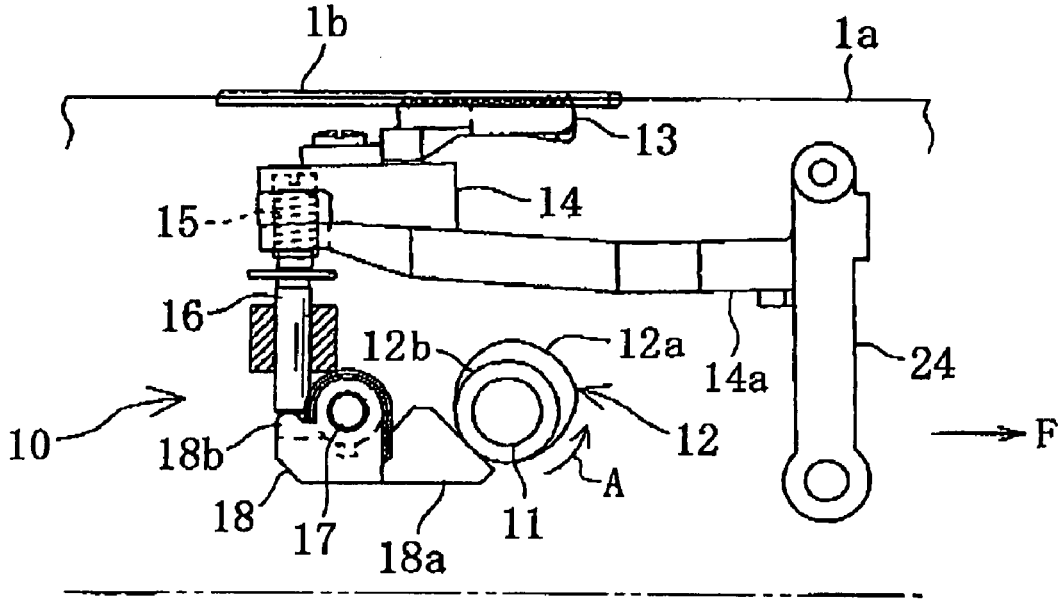
FIG. 3D is a side view of the vertically-moving mechanism and the lowering mechanism of the feed dog in embroidery mode when a lower shaft assumes a different phase.

Next, the feed dog lowering mechanism 20 for switching the feed dog 13 to the embroidery mode that retains the feed dog 13 in the lowered position below the needle plate 1*b* is provided with a contact moving member 21 for laterally moving the vertical feed contact 18 in addition to the aforementioned feed dog vertically-moving mechanism 10. The contact moving member 21, as shown in FIGS. 2B and 3B, for example, is composed of a laterally elongate plate member having a pressing portion disposed in the left end thereof, which pressing portion disposed in the left side of the vertical feed contact 18.

The contact moving member 21 being positioned behind the vertical feed contact 18 and retained in a vertical disposition by a support member not shown is provided laterally movably. At this point, the contact moving member 21 has defined thereto two elongate notches 21*a* and 21*b* which notches 21*a* and 21*b* having a pin 25 inserted therethrough respectively allows the pin 25 to be laterally movable within the relative movable range within the notches 21*a* and 21*b*.

Thus, the contact moving member 21 is laterally movable between the non-contacting position (refer to FIG. 12B) in the left and the contacting position (refer to FIG. 13B) in the right. Also, provided below the contact moving member 21 is an engagement projection 21*c* projecting below the bottom surface of the free arm 1*a*. The contact moving member 21 is normally, in other words, when no external force is exerted thereon, positioned in the non-contacting position in the left. As later described in detail, the movement to the rightward contacting position via the engagement projection 21*c* by the mode switch mechanism 35 provided in the embroidery unit 30 allows the switching to the embroidery mode by being moved by the rightward pressure exerted by the vertical feed contact 18.

Also, in the present embodiment, a manual switching lever 22 positioned in the rear surface of the free arm 1*a* is provided for mode switching rendered by directly moving the vertical feed contact 18 by manual operation. That is, as shown in FIGS. 2A, 2B, 3A and 3B, for example, the manual switching lever 22 is configured in a substantial crank-form in plan view and is pivoted rotatably at its mid portion by a longitudinally-oriented pivot shaft 23. Provided at the left end of the manual switching lever 22 is an operating portion 22*b* capable of being operated from the rear side of the free arm 1*a*, and provided at the right end is a cylindrical abutment portion 22*a* abutting the vertical feed contact 18 from the left.

Thus, when the manual switching lever 22 is in the inoperable position (inoperable state) indicated at FIG. 2B, the vertical feed contact 18 is biased leftward by the spring force of the compression coil spring, and placed in the normal mode contacting the eccentric cam 12*a*. In this state, rightward movement of the vertical feed contact 18 (switch to embroidery mode) by the contact moving member 21 is enabled.

As opposed to this, when the user moves the manual switching lever 22 by rotary operation to the lock position (locked state) indicated at FIG. 3B, the vertical feed contact 18 is moved rightward resisting the spring force of the compression coil spring and the cam contact 18*a* is switched to a state (embroidery mode) in contact with the concentric cam 12*c*. Also, at this time, the vertical feed contact 18 is locked in the aforesaid position and the movement of the vertical feed contact 18 is not allowed via the contact moving member 21. Thus, in order to return the feed dog 13 to the normal mode from this state, the manual switching lever 22 needs to be rotated to the non-operable position.

The embroidery unit 30 in accordance with the present embodiment has provided thereto a mode switch mechanism 35 serving as a mode switch unit for selectively switching between the normal mode and the embroidery mode while in attachment with the free arm 1*a*. A description will be given on the mode switch mechanism 35 hereinafter with reference to FIGS. 6A, 6B, 7A, 7B, 8 and 9.

The mode switch mechanism 35 is composed of a manual switching mechanism 36 operated by the user for switching between the normal mode and the embroidery mode and an activating mechanism 37 for conveying the movement of the manual operating lever 36 to the contact moving member 21. Also, in the present embodiment, the manual operating lever 36 has provided thereto a detection switch 38 serving as a detection unit to detect the switched position of the manual operating lever 36.

Figure 6A:
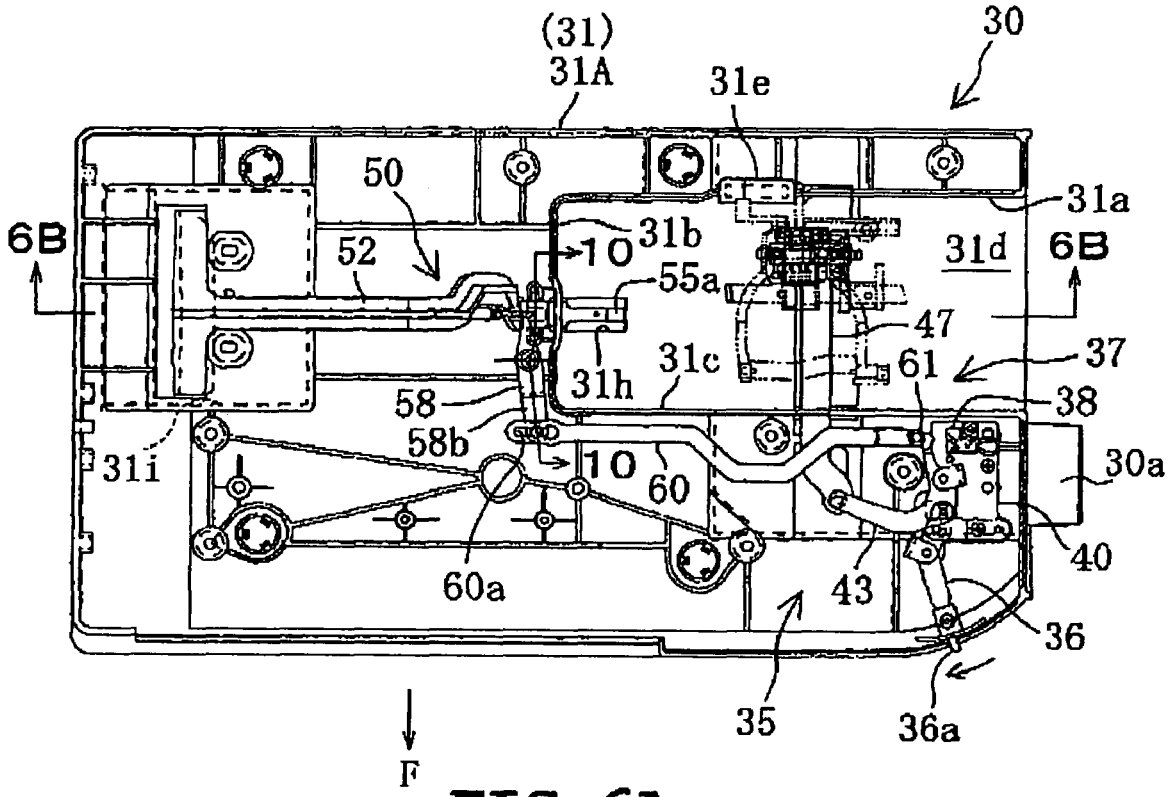
FIG. 6A is a plan view a mode switch mechanism and a selection switch mechanism in a state corresponding to embroidery mode.
Figure 7A:
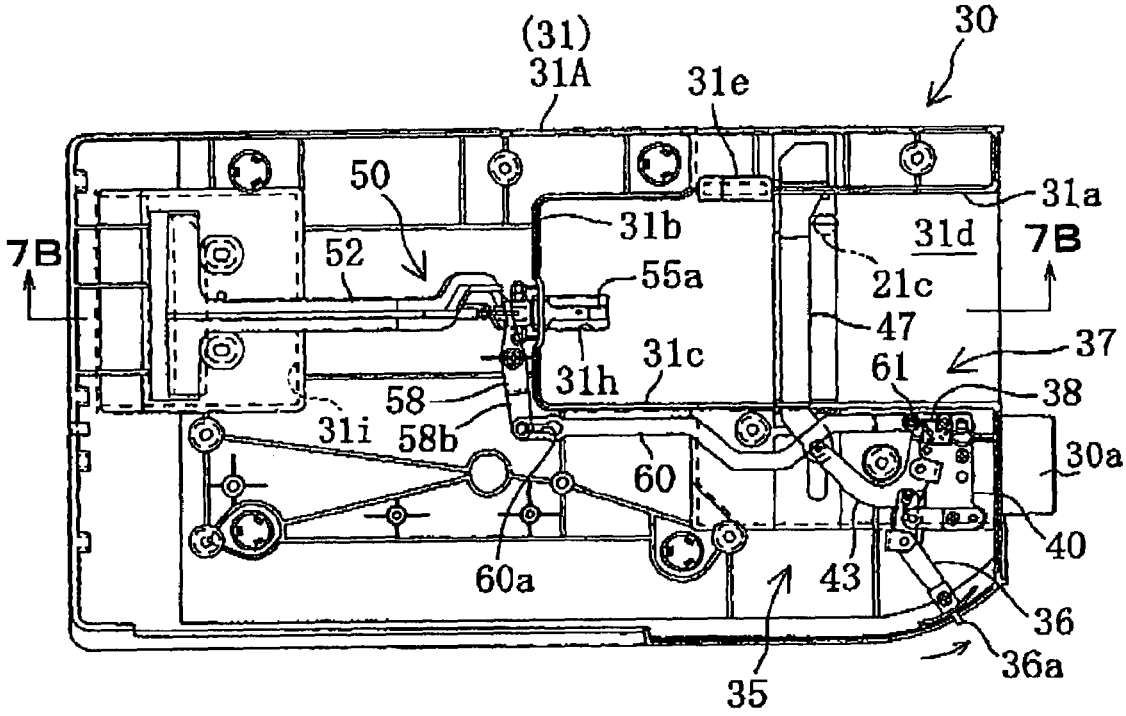
FIG. 7A is a plan view of the a mode switch mechanism and the selection switch mechanism in a state corresponding to normal mode.

Among, the foregoing, first, a description will be given on the activating mechanism 37. As shown in FIGS. 6A and 7A, for example, in the rear side of the right-half portion of the lower casing 31A of the body casing 31, partitions 31*a* to 31*c* in generally U-shape are formed in the bed receiving portion 31*d*. In the lateral-mid portion of the rear partition 31*a* forming the bed receiving portion 31*d*, a switch incline cam 31*e* is formed as a switch member for switching the manual switching lever 22 to the inoperable position.

Figure 8:
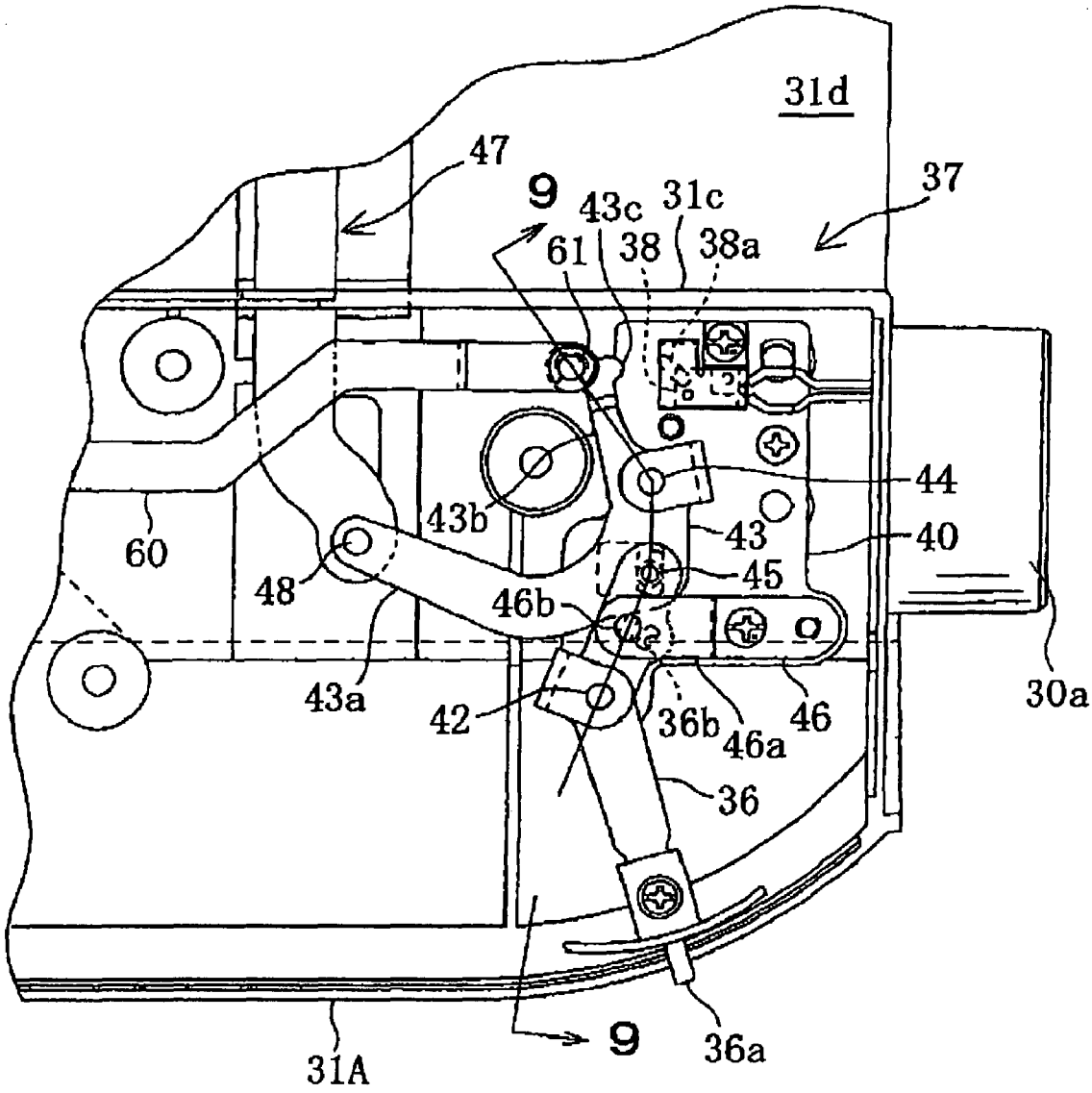
FIG. 8 an enlarged plan view of a main portion of the mode switch mechanism.

Referring to FIGS. 8 and 9, in the lower casing 31A, more specifically, in the bottom-wall of the front-right end side of the bed receiving portion 31, a base plate 40 is secured horizontally by a screw 40*a* (refer to FIG. 9). The manual operating lever 36 is in a substantially laterally-oriented V-shape in plan view and is rotatably mounted on the base plate 40 at its lengthwise mid-portion thereof by a pivot pin 42 via a spacer 41. Further, a swing member 43 substantially bifurcated in plan view is pivoted rotatably to the base plate at the curved portion thereof by a pivot pin 44.

The manual operating lever 36 has its front end extending upward which front end has an operating tip 36*a* secured on the distal end thereof. As shown in FIGS. 1 and 5, the operating tip 36*a* is disposed in a forwardly projecting manner through the opening of the body casing 31, and allows lateral sliding (rotating) operation by the user. The rear end of the manual operating lever 36 is connected rotatably by a connecting pin 45 at the mid-portion (forward relative to the pivot portion pivoted by the pivot pin 44) of the swing member 43.

At this point, two left and right notches 36*b* (only one of which indicated at FIGS. 8 and 9) are defined in the rear-end side of the manual operating lever 36. Mounted on the right-end side of the base plate 40 front-end is a locate plate 46 made of leaf-spring material. The left-end side 46*a* of the locate plate 46 is positioned on the upper surface of the manual operating lever 36 and a downward projection 46*b* engagable with the notch 36*b* is formed in the underside thereof. Thus, engagement of the projection 46*b* with either of the left or right notch 36*b* constitutes a detent mechanism allowing the positioning of the manual operating lever 36. In this case, as shown in FIG. 7, the operating tip 36*a* rotated to the right is identified as the normal operating position corresponding to the normal mode and the operating tip 36*a* rotated to the left as shown in FIG. 6 is identified as the embroidery operation position corresponding to the embroidery mode.

On the other hand, as shown in FIGS. 12 to 15, for example, the inner bottom portion of the lower casing 31A has a longitudinally elongated activating plate 47 in thin plate-form provided slidably in the longitudinal direction so as to longitudinally traverse the central-right portion of the bed receiving portion 31*d*. Most of the activating plate 47 except for the rear-end portion is identified as a non-activating plate 47*a* having small lateral-width, the rear-end portion of which has formed thereto an activating plate portion 47*c* having large lateral-width via an activating incline cam 47*b*. As shown in FIG. 8, for example, the front end of the activating plate 47 is connected to the distal end of a first arm 43*a* of the swing member 43 via a connecting pin 48.

Thus, as shown in FIGS. 6A and 8, when in the embroidery operation position where the operating tip 36*a* is operated to the left, the swing member 43 rotates counterclockwise in plan view about a pivot pin 44 via the connecting pin 45 since the manual operating lever 36 rotates clockwise in plan view about a pivot pin 42. The activating plate 47 moves forward since the distal end of the first arm 43*a* of the swing member 43 moves forward. At this time, the activating plate portion 47*c* of the activating plate 47 is positioned in the rear end portion of the bed receiving portion 31*d*. In this state, the activating plate portion 47*c* of the activating plate 47 abuts the left side surface of the engagement projection 21*c* projecting below the above described contact moving member 21, thereby moving the contact moving member 21 to the rightward contact portion. Thus, the feed dog 13 is switched to the embroidery mode.

As opposed to this, as shown in FIG. 7A, when in the normal operation position where the operating tip 36*a* is operated rightward, the swing member 43 rotates clockwise in plan view about a pivot pin 44 via the connecting pin 45 since the manual operating lever 36 rotates counterclockwise in plan view about the pivot pin 42 and the distal end of the first arm 43*a* of the swing member 43 moves rearward and the activating plate 47 moves rearward. At this time, the activating plate portion 47*c* of the activating plate 47 is retracted further reward relative to the bed receiving portion 31*d* and the non-activating plate portion 47*a* is positioned entirely across the bed receiving portion 31*d*. In this state, the activating plate 47 does not move the engagement projection 21*c*, thereby retaining the contact moving member 21*c* to the leftward non-contacting portion, thus, the feed dog 13 is switched to the normal mode.

Figure 12B:
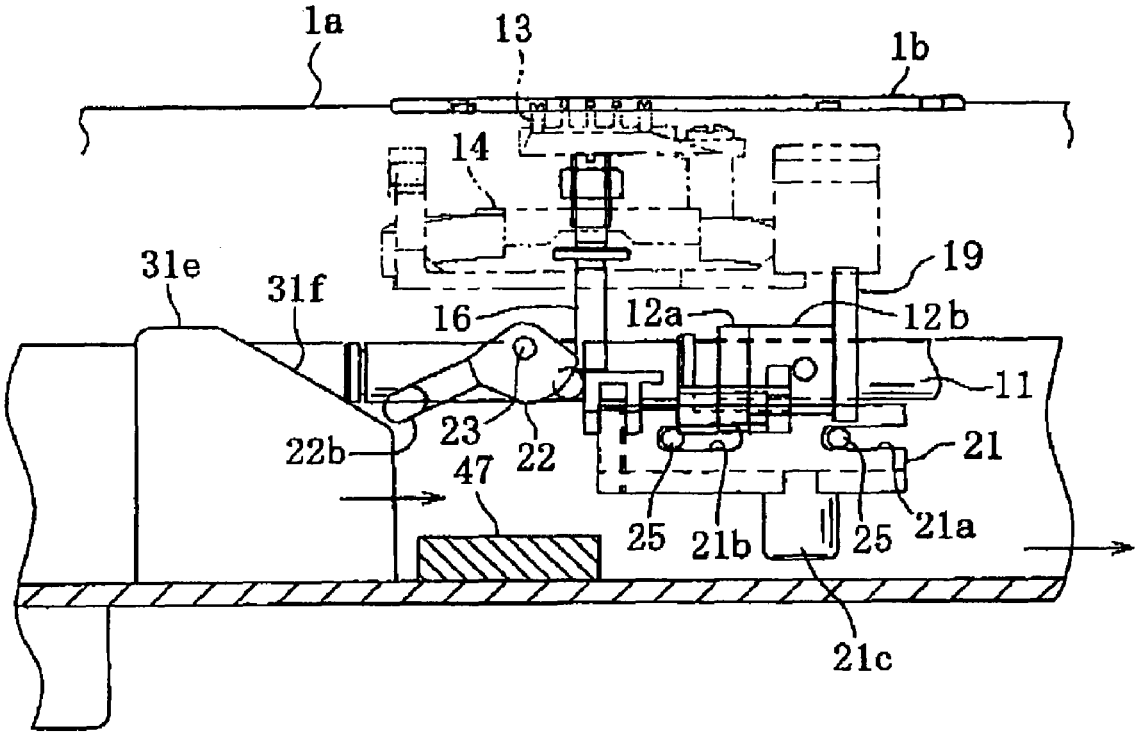
FIG. 12B is a front view indicating status of the vertically-moving mechanism and the lowering mechanism of the feed dog when the embroidery unit is being attached to the free arm.
Figure 13B:
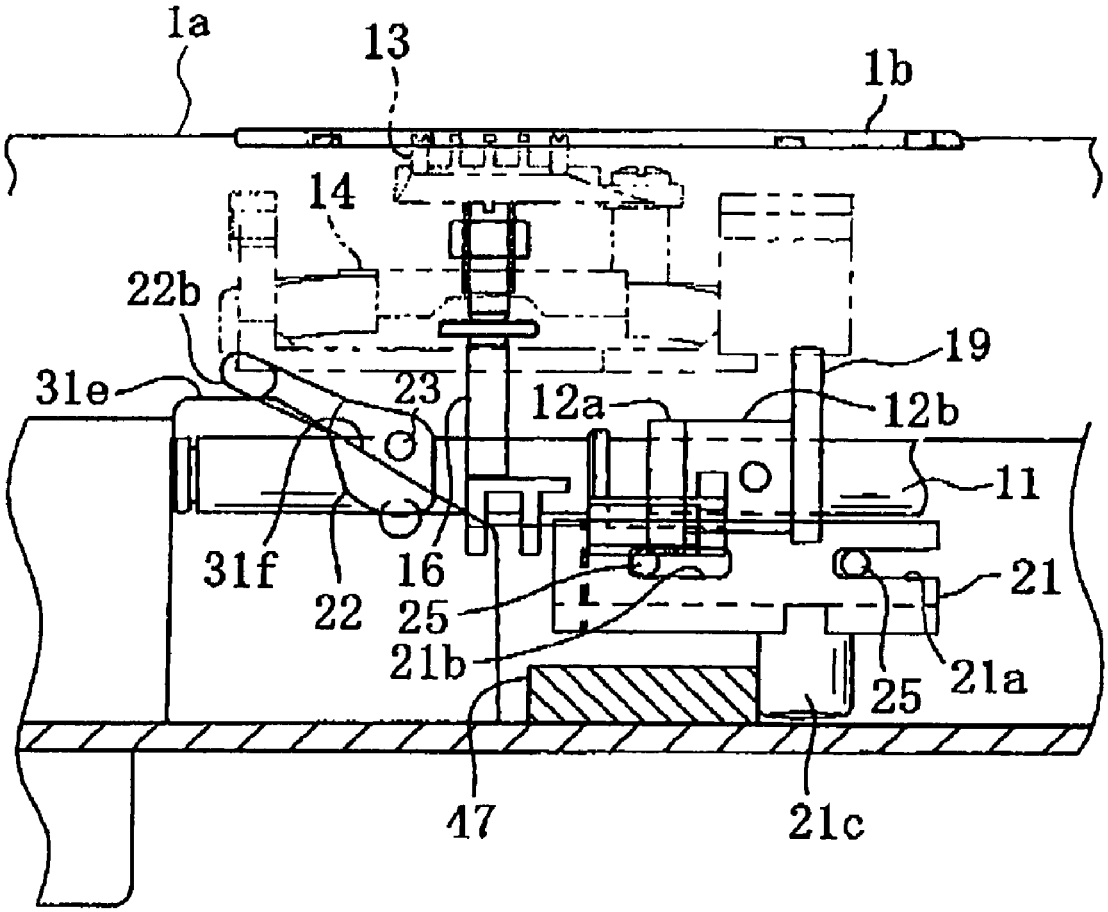
FIG. 13B is a front view indicating status of the vertically-moving mechanism and the lowering mechanism of the feed dog with the embroidery unit attached.
Figure 14A:
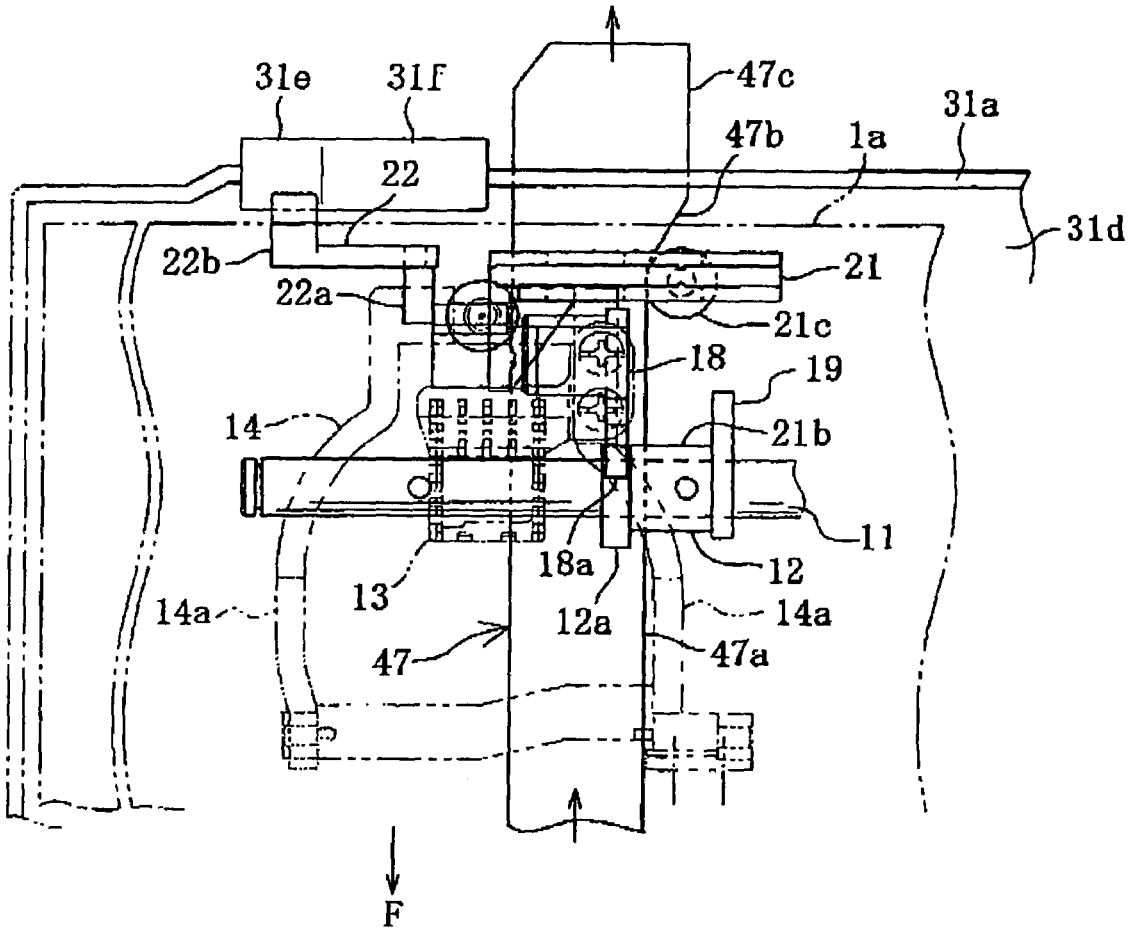
FIG. 14A is a front view indicating status of the vertically-moving mechanism and the lowering mechanism of the feed dog with a switch being made from embroidery mode to normal mode by mode switch mechanism.
Figure 14B:
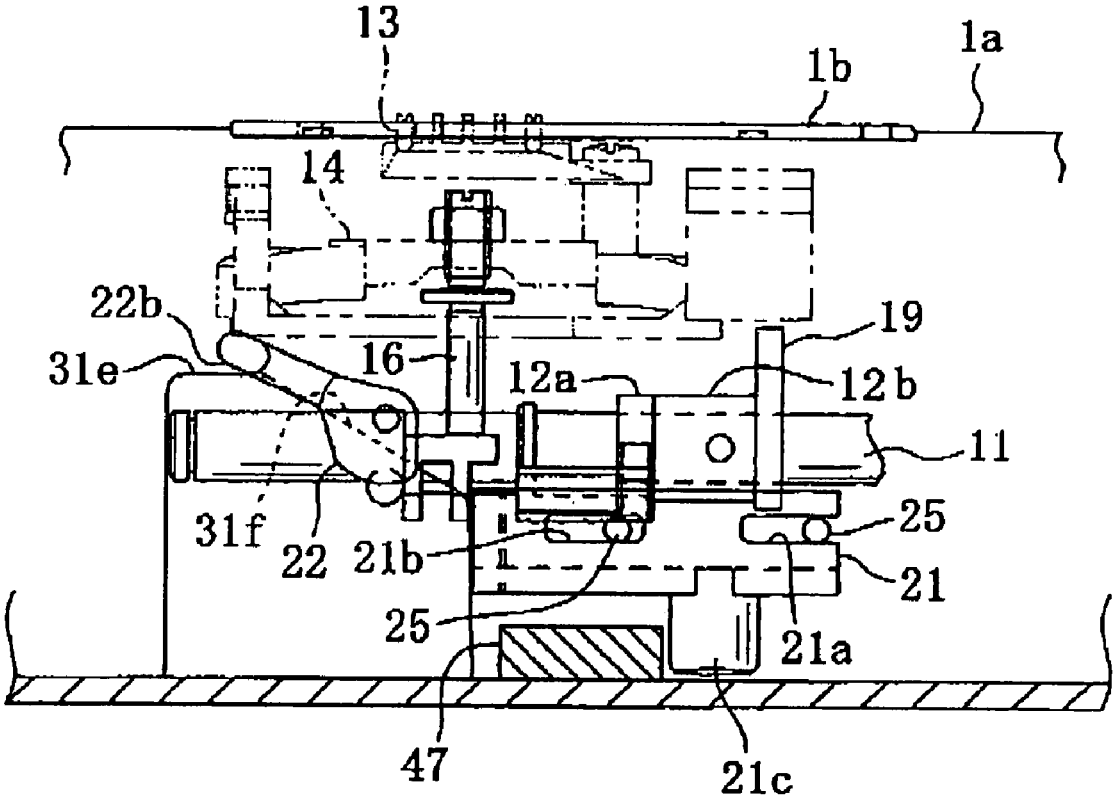
FIG. 14B is a front view indicating status of the vertically-moving mechanism and the lowering mechanism of the feed dog with a switch being made from embroidery mode to normal mode by mode switch mechanism.

Upon attachment of the embroidery unit 30 to the sewing machine bed 1, the free arm 1*a* is slid relatively rightward so as to fit the free arm 1*a* into the bed receiving portion 31*d*. At this point, even if the manual switching lever 22 in the sewing machine M side is in the locked position, as shown in FIGS. 12A and 12B, the operating portion 22*b* of the manual switching lever 22 is moved upward along an incline cam surface 31*f* of the switch incline cam 31*e*, as shown in FIGS. 13A and 13B, the operating portion 22*b* is forcibly moved upward and manual switching lever 22 is switched to the inoperable position. Also, when the embroidery unit 30 is attached to the sewing machine bed 1, user operation of the manual switching lever 22 is not allowed.

As shown in FIG. 8, for example, the detection switch 38 is composed of a micro-switch for example, and is provided in the rear end of the base plate 40. At this point, a rightwardly protruding activating portion 43*c* is provided in the rear-end portion of a second arm 43*b* of the swing member 43. When the manual operating lever 36 is in the embroidery operation position shown in FIG. 6A, the operating portion 43*c* is separated from the detection switch 38. When the manual operating lever 36 is moved to the normal operation position indicated at FIG. 7A, the activating portion 43*c* is arranged to press an operating portion 38*a* of the detection switch 38 by the rotation of the swing member 43.

Figure 11:
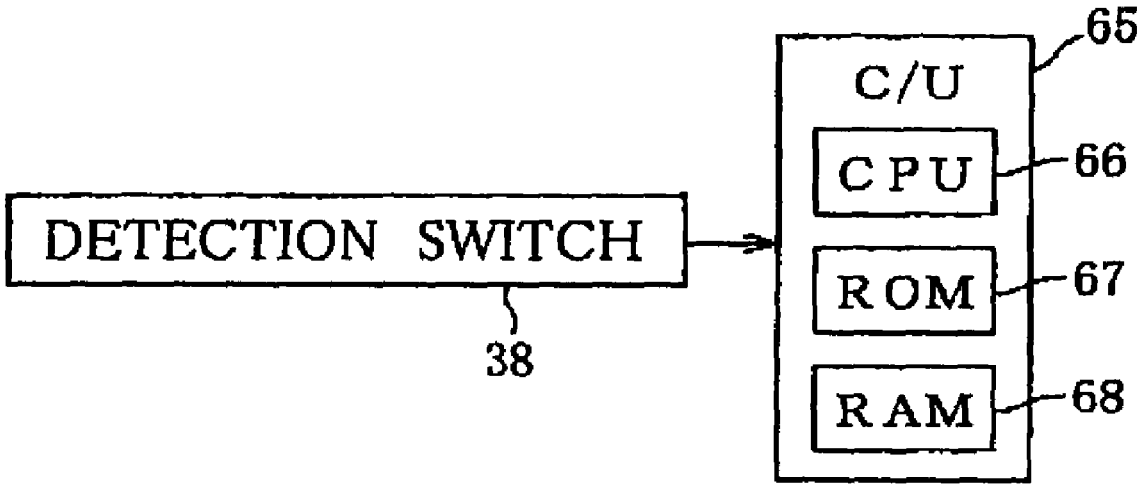
FIG. 11 is a control block diagram of a main portion.

At this point, as shown in FIG. 11, a normal mode signal switched from an "H" level signal to an "L" level signal is outputted from the detection switch 38 to the control unit 65 serving as a control device of the sewing machine M. On the other hand, when the manual operating lever 36 is switched to the embroidery operation position, the "H" level signal is outputted from the detection switch 38. The control unit 65 is configured by a microcomputer provided with a CPU 66, ROM 67, and a RAM 68, for example, and functions as a control section to control the sewing machine M and the embroidery unit 30 in its entirety. The control unit 65 is arranged to control the operation of the sewing machine M based on the position detection signal of the manual operating lever 36 delivered from the detection switch 38.

Figure 10:
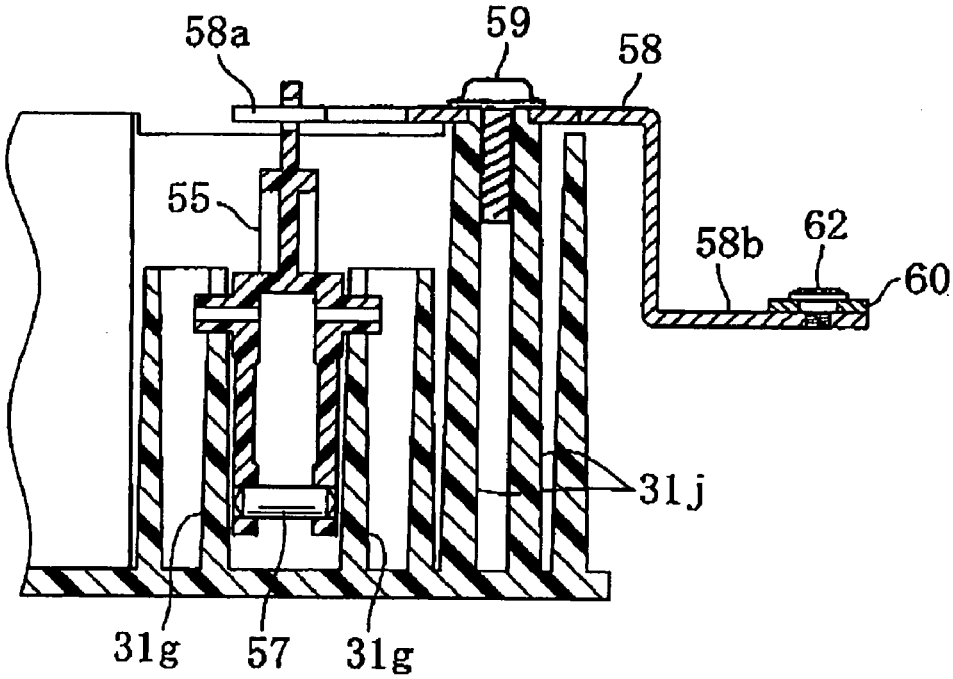
FIG. 10 is a vertical side view taken along line 10-10 in FIG. 6A.

Further, the embroidery unit 30 is provided with a lock mechanism 51 that locks the embroidery unit 30 in attachment with the free arm 1*a*, and an unlock lever 52, and the like, for unlocking the lock mechanism 51. First, to describe the lock mechanism, as shown in FIGS. 6A, 6B, 7A, 7B and 10, for example, a hook member 55 in substantial L-shape in front view is disposed to the immediate left side of the partition 31*b* that divides off the bed receiving portion 31*d*. As shown in FIG. 10, the hook member 55 at the upper side of its vertical portion is pivoted rotatably by a pair of front and rear pivot wall 31*g*. An engagement hook 55*a* is formed at the distal end (right end) of the horizontal portion of the hook member 55 and a downwardly caved receiving recess 31*h* is defined in the bottom wall of the lower casing 31A corresponding to the portion below the engagement hook 55*a*.

Figure 6B:
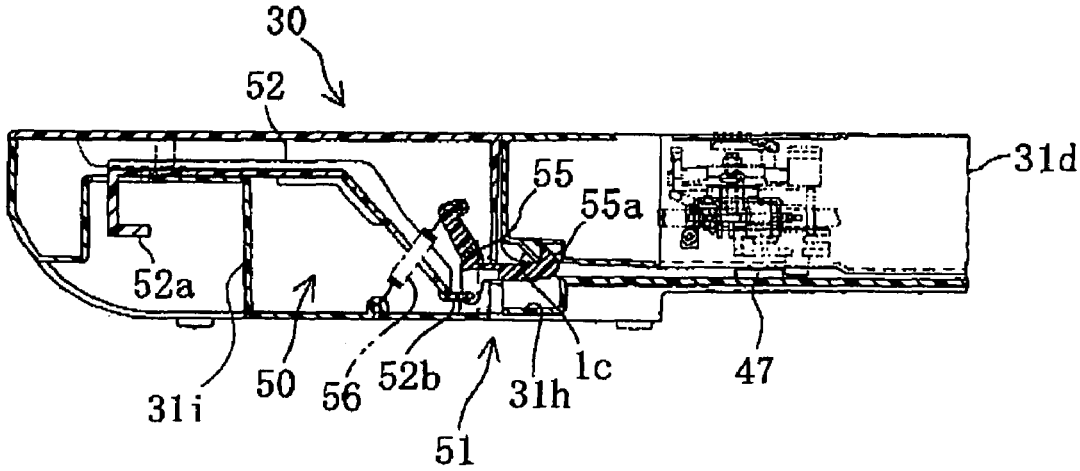
FIG. 6B is a vertical front view taken along line 6B-6B in FIG. 6A.
Figure 7B:
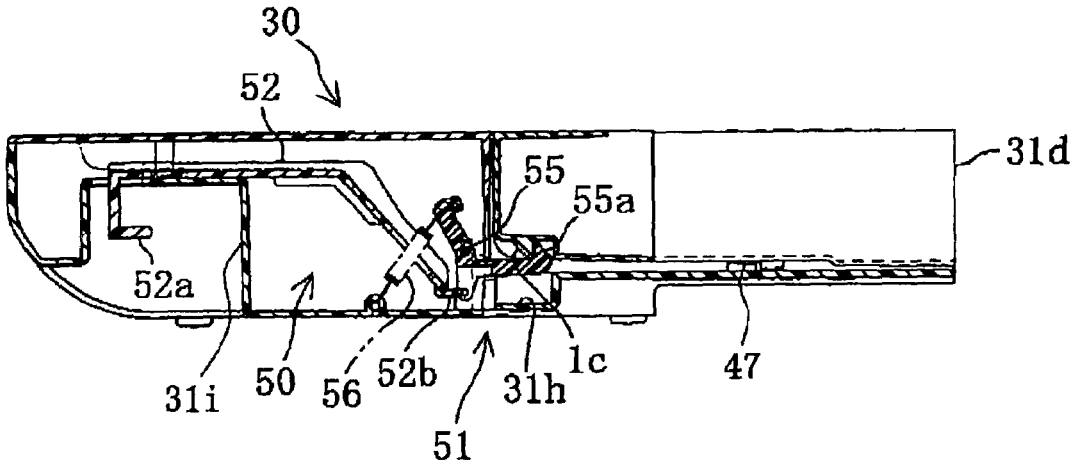
FIG. 7B is a vertical front view taken along line 7B-7B in FIG. 7A.

As shown in FIGS. 6B and 7B, a sloped extension coil spring 56 is hooked across the upper end of the hook member 55 and the bottom wall of the lower casing 31A. Thus, the hook member 55 is subject to consistent bias in counterclockwise direction in front view by the spring force of the extension coil spring 56, and the engagement hook 55*a* faces the lower portion of the bed receiving portion 31*d*.

Upon attachment of the embroidery unit 30 to the free arm 1*a*, the engagement hook 55*a* is moved downward so as to plunge into the accommodating recess 31*h* by the incline of a hook subject portion 1*c* formed in the free arm 1*a*, thereafter, as shown in FIG. 6B, the engagement hook 55*a* is returned upward to engage with the hook subject 1*c* in front the downward right direction. As a result, the embroidery unit 30 is locked in attachment with the free arm 1*a*.

As opposed to this, as shown in FIGS. 6B and 7B for example, a handle accommodating recess 31*i* substantially caved upward (opened from the lower side to the left side) is defined at the left end portion of the lower casing 31A to the left of the bed accommodating portion 31*d*. The unlock lever 52 extends laterally from the handle accommodating recess 31*i* to the proximity of the bed accommodating portion 31*d*. The unlock lever 52 has, in the left end thereof, an unlock-operating portion 52*a* formed as a downward right curvature and a connecting portion 52*b* in the right end thereof. The connecting portion 52*b* is connected to the lower end of the vertical portion of the hook member 55 by a connecting pin 57. The unlock-operating portion 52*a* is disposed within the handle accommodating recess 31*i* into which the user is allowed to reach his/hands and pull the unlock-operating portion 52*a* leftward.

Figure 15A:
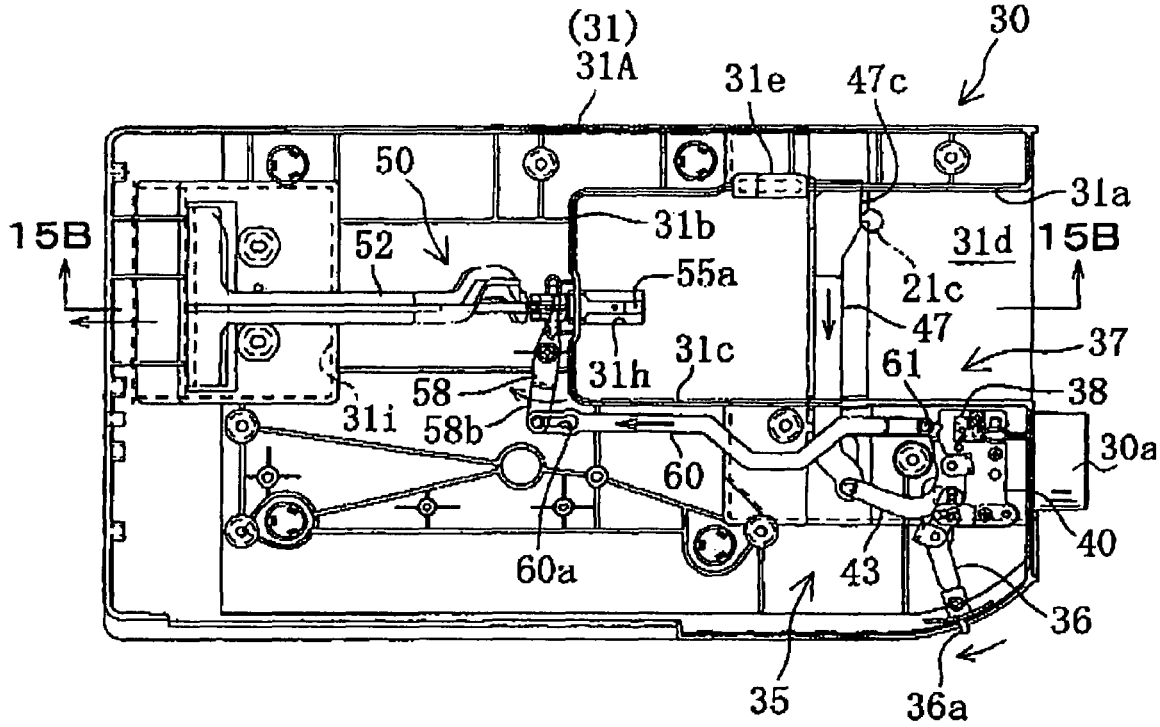
FIG. 15A is a transverse plan view of the embroidery unit indicating an activating mechanism and a lock mechanism.
Figure 15B:
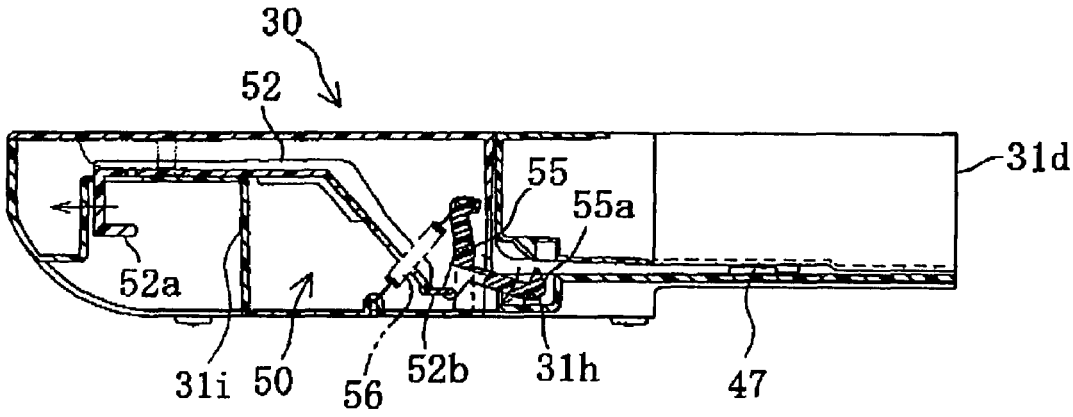
FIG. 15B is a vertical front view taken along line 15B-15B in FIG. 15A.

When the user pulls the unlock-operating portion 52*a* leftward, as shown in FIG. 15B, the hook member 55 is rotated clockwise in front view. Thus, the engagement hook 55*a* is retracted into the accommodating recess 31*h* below to disengage the engagement hook 55*a* from the hook subject portion 1*c*, thereby unlocking the lock mechanism 51. Thus, the user is subsequently allowed to remove the embroidery unit 30 from the free arm 1*a*. When the user releases the pull of the unlock-operating portion 52*a*, the hook member 55 returns to the original position by the spring force, whereby the unlocking lever returns to the original position as well.

In the present embodiment, the embroidery unit 30 is provided with a selection switch mechanism 50 serving as a selection switch unit for placing the status of the mode switch mechanism 35 to the embroidery mode, more specifically, for forcibly switching the manual operating lever 36 to the embroidery operating position in synchronization with the removal of the embroidery unit 30 from the sewing machine bed 1. In the present embodiment, the selection switch mechanism 50 is arranged to switch the manual operating lever 36 to the embroidery operation position in synchronization with the operation of the unlock lever 52.

More specifically, as shown in FIGS. 6A, 7A, 10, and 15A, a rotary lever 58 taking a crank-form in side view is rotatably pivoted by a screw 59 (refer to FIG. 10) to a support wall 31*j* immediately in front of the hook member 55. As shown in FIG. 10, a first connecting portion 58*a* of the rotary lever 58 is engaged with the upper end of the hook member 55. On the other hand, as shown in FIG. 8, for example, a laterally-oriented switch lever 60 is disposed between the rotary lever 58 and the swing member 43, and the right end of the switch lever 60 is connected to the distal end of the second arm 43*b* of the swing member 43 by a connecting pin 61. As shown in FIG. 6A, for example, the connecting pin 62 is secured to the second connecting portion 58*b* of the rotary lever 58, and the connecting pin 62 is connected to a notched through-hole 60*a*, taking an oval-form, defined in the left end of the switch lever 60.

Thus, when the lock mechanism 51 is unlocked by the unlock lever 52, the rotary lever 58 moving in synchronization with the hook member 55 is rotated clockwise in plan view and moves a switch lever 60 leftward via the connecting pin 62. As a result, since the second arm 43*b* of the swing member 43 is pulled to the left, the swing member 43 is rotated counterclockwise and as shown in FIG. 15A the manual operating lever 36 is forcibly switched to the embroidery operation position in the left side. However, when switching the manual operating lever 36, even if the switch lever 60 is laterally moved in synchronization with the rotation of the swing lever 43, the lock mechanism 51 is not activated toward the unlocking side due to the notched through-hole 60*a* in oval form.

Next, an explanation will be given on the operation of the above described configuration.

When the embroidery unit 30 is removed from the sewing machine bed 1, the sewing machine M alone is capable of executing sewing operation for utility sewing such as lock stitching and zigzag sewing. At this point, as shown in FIGS. 2A to 2D, for example, by placing the feed dog 13 in the normal mode where the manual switching lever 22 is in the inoperable position, the feed dog 13 is vertically moved (and longitudinally moved) to execute sewing operation while performing cloth feed. Also, when the embroidery unit 30 is detached, as shown in FIGS. 3A to 3D, the user operation of the manual switching lever 22 to the lock position switches the feed dog 13 to the embroidery mode. In the embroidery mode, since the feed dog 13 does not project above the needle plate 1*b* and no cloth feed is performed, buttoning and kilting activities can be performed.

As opposed to this, when the user wishes to execute embroidery sewing, embroidery unit 30 is to be attached to the sewing machine bed 1. In case the manual switching lever 22 is in the locked position as described above, the attachment of the embroidery unit 30 forces the manual switching lever 22 to be returned to the inoperable position by the switch incline cam 31*e*. Also, the embroidery unit 30 is locked in attachment with the free arm 1*a* by the lock mechanism 51.

In such attached state of the embroidery unit 30, as shown in FIGS. 6A and 8, for example, the manual operating lever 36 being positioned in the embroidery operation position (operating tip 36*a* placed in the left side) causes the contact moving member 21 to be moved to the contact position in the right side by the activating portion 47*c* of the activating plate 47, thereby placing the feed dog 13 in the embroidery mode. In this state, embroidery sewing can be executed by moving the embroidery frame 33 holding the workpiece cloth with no interference of the feed dog 13.

Also, even if the embroidery unit 30 is attached, as shown in FIG. 7A, for example, by the user's operation of the operating handle 36*a* to the right side to switch the manual operating lever 36 to the normal operation position, the feed dog 13 is switched to the normal mode since the activating plate 47 is moved reward so as not to press the contact moving member 21. Under such state, by removing the embroidery frame 33 from the embroidery unit 30, for example, utility sewing can be executed with cloth feed rendered by the feed dog 13 while using the body casing 31 as an auxiliary table (with the sewing machine bed 1 spread). The user is allowed to switch the feed dog 13 to the embroidery mode again by switching the manual operating lever 36 from the normal operating position to the embroidery operating position.

The signal delivered from the detection switch 38 that detects the position of the manual operating lever 36 is outputted to the control unit 65. The control unit 65 is capable of switching between the pattern selection control and sewing control as required based on the signal delivered from the control unit 65 to render appropriate control.

At this time, when the embroidery unit 30 is being attached (before attachment), in case the manual operating lever 36 is in the normal operation position, when the user intending to execute embroidery sewing attaches the embroidery unit 30 to the sewing machine bed 1, the mode of the feed dog 13 is placed in the normal mode. Hence, the user is required to verify the current mode of the feed dog 13 (the positioning of the manual operating lever 36), and make a switch to the embroidery operation position if in the normal mode. In another case, if embroidery sewing is started without verification, the feed dog 13 in the normal mode is vertically moved and may lead to failure in the embroidery sewing process by the thread in the underside of the workpiece being caught by the feed dog 13, etc.

However, in the present embodiment, the aforementioned problem can be prevented since the embroidery unit 30 is provided with a selection switch mechanism 50 that switches the status of the mode switch mechanism 35 to the embroidery mode, more specifically, the manual operating lever 36 is forcibly switched to the embroidery operation position when removing the embroidery unit 30 from the sewing machine bed 1 in synchronization with the removing operation of the embroidery unit 30 from the sewing machine bed 1.

That is, upon removal of the embroidery unit 30 from the free arm 1*a*, the user is to pull the unlock lever 52 leftward by hooking his/her fingers with the cancel operation portion 52*a* to cancel the locked state of the lock mechanism 51. Then, as shown in FIG. 15A, the locked status of the engagement hook 55*a* and hook subject portion 1*c* is cancelled and the manual operation lever 36 is forcibly switched to the embroidery operation position via the rotary lever 58 in synchronization with the hook member 55, the switch lever 60, and the swing member 43.

Thus, when the embroidery unit 30 removed from the free arm 1*a*, the manual operating lever 36 is consistently positioned in the embroidery operation position. Consequently, the status of the feed dog 13 is automatically switched to the embroidery mode by the mode switch mechanism 35 of the embroidery unit 30 in the subsequent attachment of the embroidery unit 30 to the sewing machine bed 1 regardless of the mode of the feed dog 13 in the sewing machine M side. Thus, no verification of the positioning of the manual operating lever 36 (the mode of the feed dog 13) is required on the part of the user, and no switching operation is required to place the manual operating lever 36 in the embroidery operation position, allowing embroidery sewing to be started straight after attachment of the embroidery unit 30.

Thus, according to the present embodiment, the embroidery unit 30 is provided with a selection switch mechanism 50 provided with a mode switch mechanism 35 composed of a manual operating lever 36 for switching the mode of the feed dog 13 in the sewing machine M side, and the like, and forcibly moving the manual operating lever 36 to the embroidery operation position in the embroidery mode side in synchronization with the removing operation of the embroidery unit 30 from the sewing machine bed 1. Thus, when the user attaches the embroidery unit 30 to the sewing machine bed 1 with an intention of executing an embroidery sewing operation, the mode of the feed dog 13 is automatically switched to the embroidery mode without requiring troublesome verification and operation on the part of the user and providing an advantageous effect of allowing a smooth initiation of embroidery sewing operation.

Furthermore, particularly in the present embodiment, the manual operation lever 36 is arranged to be switched to the embroidery operation position in synchronization with the operation of the unlock lever 52 that cancels the locked status of the lock mechanism 51, thus, the selection switch mechanism 50 can be realized by merely adding a plurality of levers such as the rotary lever 58 and the switch lever 60 operating in synchronization with the hook member 55. As a result, an advantage is obtained in which the configuration of the selection switch mechanism 50 can be kept relatively simple while achieving reliable operation of the selection switch mechanism 50.

The present invention is not limited to the embodiment described above but may be implemented by incorporating various modifications within the scope of the invention by one skilled in the art and the present invention is inclusive of all such modifications.

INDUSTRIAL APPLICABILITY

As described above, the embroidery unit attachable to the sewing machine bed in accordance with the present embodiment is useful in detachably attaching the embroidery unit for executing embroidery sewing.

The invention claimed is:

1. An embroidery unit attachable to a sewing machine bed of a sewing machine capable of executing a normal mode executing sewing operation while vertically moving a feed dog provided in the sewing machine bed and an embroidery mode executing sewing operation while maintaining the feed dog below a needle plate and provided with an embroidery frame feed mechanism moving an embroidery frame holding a workpiece cloth, comprising:

a mode switch unit for selectively switching the feed dog between the normal mode and the embroidery mode with the embroidery unit attached to the sewing machine bed; and a selection switch unit switching status of the mode switch unit to embroidery mode in synchronization with a removing operation when removing the embroidery unit from the sewing machine bed.

2. The embroidery unit attachable to a sewing machine bed of claim 1, wherein the sewing machine bed is provided with a feed dog lowering mechanism moving the feed dog to a lowered position below the needle plate, and the feed dog lowering mechanism is activated by the mode switch unit.

3. The embroidery unit attachable to a sewing machine bed of claim 2, wherein the feed dog lowering mechanism includes a vertical feed cam composed of an eccentric cam for vertically moving the feed dog and a concentric cam for maintaining the feed dog in the lowered position which are secured to a lower shaft; a vertical feed contact contacting either of the eccentric cam and the concentric cam; and a contact moving member for moving the vertical feed contact and the mode switch unit is arranged to move the contact moving member.

4. The embroidery unit attachable to a sewing machine bed of claim 3, wherein the mode switch unit includes a manual operating lever operated for switching between the embroidery mode and the normal mode and an activating mechanism conveying the movement of the manual operating lever to the contact moving member.

5. The embroidery unit attachable to a sewing machine bed of claim 4, further comprising a lock mechanism for locking in attachment with the sewing machine bed and an unlock lever for canceling the lock by the lock mechanism, and the selection switch unit is arranged to switch the manual operating lever to a position corresponding to the embroidery mode in synchronization with the operation of the unlock lever.

6. The embroidery unit attachable to a sewing machine bed of claim 4, further comprising a detection unit detecting position of the manual operating lever and information pertaining to the position of the manual operating lever detected by the detection unit is outputted to a control section of the sewing machine.

7. The embroidery unit attachable to a sewing machine bed of claim 3, wherein the sewing machine bed includes a manual switching lever for switching between a locked state placing the vertical feed contact in contact with the concentric cam and locking the vertical feed contact unmovably toward the concentric cam and an inoperable state allowing movement of the vertical feed contact; and a switch member switching the manual switching lever to the inoperable state in synchronization with attachment operation upon attachment of the embroidery unit to the sewing machine bed.

* * * * *